US007678523B2

(12) United States Patent
Hiroko et al.

(10) Patent No.: US 7,678,523 B2
(45) Date of Patent: Mar. 16, 2010

(54) MAGNETIC TONER

(75) Inventors: Shuichi Hiroko, Susono (JP); Tadashi Dojo, Numazu (JP); Michihisa Magome, Mishima (JP); Eriko Yanase, Suntou-gun (JP); Takashi Matsui, Suntou-gun (JP); Tomohisa Sano, Suntou-gun (JP); Akira Sakakibara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/330,658

(22) Filed: Dec. 9, 2008

(65) Prior Publication Data

US 2009/0092919 A1 Apr. 9, 2009

Related U.S. Application Data

(63) Continuation of application No. PCT/JP2008/06080, filed on Jun. 6, 2008.

(30) Foreign Application Priority Data

Jun. 8, 2007 (JP) ..... 2007-152223

(51) Int. Cl.
*G03G 9/00* (2006.01)

(52) U.S. Cl. ..... 430/111.4; 430/111.41; 430/110.1

(58) Field of Classification Search ..... 430/111.4, 430/111.41, 110.1
See application file for complete search history.

(56) References Cited

U.S. PATENT DOCUMENTS

| | | | | |
|---|---|---|---|---|
| 3,578,797 | A | 5/1971 | Hodges | 263/3 |
| 5,114,337 | A | 5/1992 | Yamazaki | 432/8 |
| 2003/0036008 | A1 | 2/2003 | Yamazaki et al. | 430/123.5 |
| 2004/0157147 | A1 | 8/2004 | Shiraishi et al. | 430/109.4 |
| 2005/0106485 | A1 | 5/2005 | Yamazaki et al. | 430/106.1 |
| 2007/0059049 | A1 | 3/2007 | Onuma et al. | 399/284 |
| 2007/0141499 | A1 | 6/2007 | Yamazaki et al. | 430/109.3 |

FOREIGN PATENT DOCUMENTS

| | | |
|---|---|---|
| JP | 03-067270 | 3/1991 |
| JP | 06-011898 | 1/1994 |

(Continued)

OTHER PUBLICATIONS

International Search Report, App. No. PCT/JP208/06080/060803, Jun. 25, 2008.

*Primary Examiner*—Mark A Chapman
(74) *Attorney, Agent, or Firm*—Fitzpatrick, Cella, Harper & Scinto

(57) ABSTRACT

To provide a magnetic toner which has superior low-temperature fixing performance and pressure roller anti-staining properties even in various forms of use, has been kept from image defects such as image non-uniformity even during long-time image reproduction and can achieve high-level image quality. In a magnetic toner having toner particles containing at least a binder resin and a magnetic material, the activation energy Ea (kJ/mol) that is determined from a shift factor $aT_{120}$ in a master curve of the toner, prepared when 120° C. is set as reference temperature, and the activation energy Eb (kJ/mol) that is determined from a shift factor $aT_{150}$ in a master curve of the toner, prepared when 150° C. is set as reference temperature, satisfy Expression (1), and the Ea is 110 kJ/mol or less:

$$1.00 \leq Ea/Eb < 1.20 \quad (1).$$

6 Claims, 2 Drawing Sheets

FOREIGN PATENT DOCUMENTS

| | | |
|---|---|---|
| JP | 11-143127 | 5/1999 |
| JP | 2000-003077 | 1/2000 |
| JP | 2002-040708 | 2/2002 |
| JP | 2002-148845 | 5/2002 |
| JP | 2002-372802 | 12/2002 |
| JP | 2002-372806 | 12/2002 |
| JP | 2003-122047 | 4/2003 |
| JP | 2004-245887 | 9/2004 |
| JP | 2005-091437 | 4/2005 |
| JP | 2005-134891 | 5/2005 |
| JP | 2007-108675 | 4/2007 |
| WO | WO 2007/049802 | 6/2007 |

MAGNETIC TONER

This application is a continuation of International Application No. PCT/JP2008/060803, filed Jun. 6, 2008, which claims the benefit of Japanese Patent Application No. 2007-152223, filed Jun. 8, 2007.

BACKGROUND OF THE INVENTION

1. Field of the Invention

This invention relates to a magnetic toner used in image forming methods for rendering electrostatic latent images visible, as in electrophotography.

2. Description of the Related Art

A number of methods are known as methods for electrophotography. In general, a copy or print is obtained by forming an electrostatic latent image on an electrostatically charged image bearing member (hereinafter also "photosensitive member") by utilizing a photoconductive material and by various means, subsequently developing the latent image by the use of a toner to form a toner image as a visible image, transferring the toner image to a recording medium such as paper as occasion calls, and then fixing the toner image onto the recording medium by the action of heat and/or pressure. Apparatus for such image formation include copying machines, printers and so forth.

In recent years, these printers or copying machines are being changed over from analogue machines to digital machines, and it is required to have a good reproducibility of latent images, be free of any color-non-uniformity and so forth and have a high image quality. Also, at the same time therewith, the main bodies of such printers or copying machines are being made compact and energy-saving.

From the viewpoint of making the apparatus compact, a magnetic one-component development system is preferably used, which requires no carrier. In a magnetic toner used in the magnetic one-component development system, a finely powdery magnetic material, a wax and so forth are dispersed in its particles in a fairly large quantity, and hence how the magnetic material and wax and a binder resin are present therein has a great influence on fixing performance, fluidity, environmental stability, triboelectric chargeability and so forth of the magnetic toner.

To make the apparatus compact, this one-component developing system does not require any carrier particles such as glass beads or iron powder, which are required in a two-component developing system, and hence can make the developing assembly itself compact and light-weight.

Here, take note of printers, for example. The form of use on printers is being divided into two forms. One is a large-sized printer adaptable to a network, where the printing is often performed on a large number of sheets at one time. The other is a personal printer for personal use in offices or for SOHO (small office home office). The personal printer may vary in the number of sheets in printing on account of its form of use, where the printing is often performed on from one sheet to tens of sheets. Hence, in order to make adaptation not only to demands for the main body but also to such various forms of use, the printer is required to take an approach to the achievement of higher function from an aspect of developers. In addition, because of an increasing need for energy saving in recent years, in order to make electric power less consumed at the time of stand-by, many models employ what is called a sleep mode which keeps electric power from being consumed when not used for a long time. However, usually, a printer having come into such a sleep mode often takes a time to come back into a usual printable condition. For users, it is an important function to obtain prints on demand at any time. Hence, making the main body rise in a shorter time is a necessary and indispensable function in the present market of printers.

Accordingly, in order to make adaptation to such various use purposes, it is an important function in the present market of printers to shorten the time for which the printing is started after the rise of the main body and also to keep a stable image quality even in mass printing.

As means by which toner visible images are fixed to recording materials, a heat roller fixing system is widely used in which a recording material holding thereon unfixed toner visible images is heated while it is held and transported between a heating roller kept at a stated temperature and a pressure roller having an elastic layer and coming into pressure contact with the heating roller. Besides, a belt fixing system is known which is disclosed in U.S. Pat. No. 3,578,797. In the heat roller fixing systems, however, they require what is called a wait time, the time for which the operation to form images is prohibited until the heating roller reaches a preset temperature. It is also necessary to keep the heating roller at an optimum temperature in order to prevent any faulty fixing due to variations in temperature of the heating roller which are caused by the passage of a recording material or other external factors and prevent what is called an offset phenomenon, in which the developer transfers to the heating roller. For this end, the heating roller or a heating element must have a large heat capacity, and a large electric power is necessary therefor, tending to require a large energy necessary for the fixing.

Also, in such a heating roller system or a heating system operated via a film, toner images held on an image-fixing sheet are fixed thereto by passing them while bringing their surface into contact with the surface of the heating roller, or the film, the surface of which has been formed of a material having release properties to the toner. In this method, the heating roller surface or film surface comes into contact with the toner images held on the image-fixing sheet, and hence the heat efficiency in fusing the toner images to the image-fixing sheet is so really good as to enable them to be rapidly fixed thereto. Thus, this is very effective in printers aiming at energy saving.

However, in such a method as well, the heating roller surface or the film surface comes into contact with the toner images in the state the latter is melted. Hence, some toner images may adhere and come transferred to the heating roller surface or film surface and may again come transferred to the heating roller or the next image-fixing sheet to stain the heating roller or the image-fixing sheet. To make no toner adhere to the heating roller surface or film surface is considered to be one of essential requirements in such heat fixing systems.

As disclosed in Japanese Patent Laid-open Applications No. 2002-040708 and No. 2002-148845, it is attempted to make a toner highly releasable from a pressure member to improve pressure roller anti-staining properties, by controlling the thermal conductivity of the pressure member and incorporating the toner with a hydrophobic metal oxide. However, there is still room for improvement as to simultaneous achievement of both fixing performance and image quality of the toner.

As also disclosed in Japanese Patent Laid-open Application No. H11-143127, it is attempted to improve low-temperature fixing performance and high-temperature anti-offset properties of a toner by controlling THF-insoluble matter and Theological characteristics of the toner. However, there is still room for improvement as to the achievement of low-temperature fixing performance and image uniformity by structural control of a magnetic material and a binder resin component in a toner as a magnetic one-component developer.

As one of specific subjects on the machine rise in a short time, it is necessary to fix toner images to a recording medium such as paper at a low temperature. However, when fixed at a low temperature, it is difficult to keep a sheet of paper at a sufficient temperature from the upper end to the lower end thereof, so that, in one sheet of paper, the heat may unevenly be applied thereto to tend to cause image defects as non-uniformity in images and cause a phenomenon which is what is called low-temperature offsetting, in which unfixed toner images stain a fixing member. In order to achieve a high-level image quality even in such a case, it is necessary to make the fixing areole uniform, showing a fixing performance that is equal without regard to some differences in fixing temperature at the upper end and lower end portions of the sheet.

In what is also disclosed in Japanese Patent Laid-open Application No. H06-011898, a toner is controlled to have an activation energy of from 30 kcal/mol to 45 kcal/mol so as to be improved in low-temperature fixing performance as a color toner.

However, there is still room for improvement from the viewpoint of simultaneous achievement of both low-temperature fixing and high-temperature anti-offset.

SUMMARY OF THE INVENTION

An object of the present invention is to provide a magnetic toner having resolved the above problems, that is, to provide a magnetic toner which has superior low-temperature fixing performance and pressure roller anti-staining properties even in various forms of use, can be free of image defects such as image non-uniformity even during printing on many sheets and can achieve high-level image quality.

The present invention is a magnetic toner having toner particles containing at least a binder resin and a magnetic material, and is characterized in that the activation energy Ea (kJ/mol) that is determined from a shift factor $aT_{120}$ in a master curve of the toner, prepared when 120° C. is set as reference temperature, and the activation energy Eb (kJ/mol) that is determined from a shift factor $aT_{150}$ in a master curve of the toner, prepared when 150° C. is set as reference temperature, satisfy Expression (1), and the Ea is 110 kJ/mol or less:

$$1.00 \leqq Ea/Eb < 1.20 \quad (1).$$

According to the present invention, the activation energy Ea (kJ/mol) that is determined from a shift factor $aT_{120}$ in a master curve of the toner, prepared when 120° C. is set as reference temperature, and the activation energy Eb (kJ/mol) that is determined from a shift factor $aT_{150}$ in a master curve of the toner, prepared when 150° C. is set as reference temperature, satisfy $1.00 \leqq Ea/Eb < 1.20$ and the Ea is 110 kJ/mol or less. In virtue of this feature, a magnetic toner can be obtained which has superior pressure roller anti-staining properties and low-temperature anti-offset properties even in various forms of use and also superior pressure roller anti-staining properties and low-temperature fixing performance and high-temperature anti-offset properties, and further can not easily cause image defects during long-time image reproduction.

Further features of the present invention will become apparent from the following description of exemplary embodiments with reference to the accompanying drawings.

DESCRIPTION OF THE EMBODIMENTS

Figure 1:
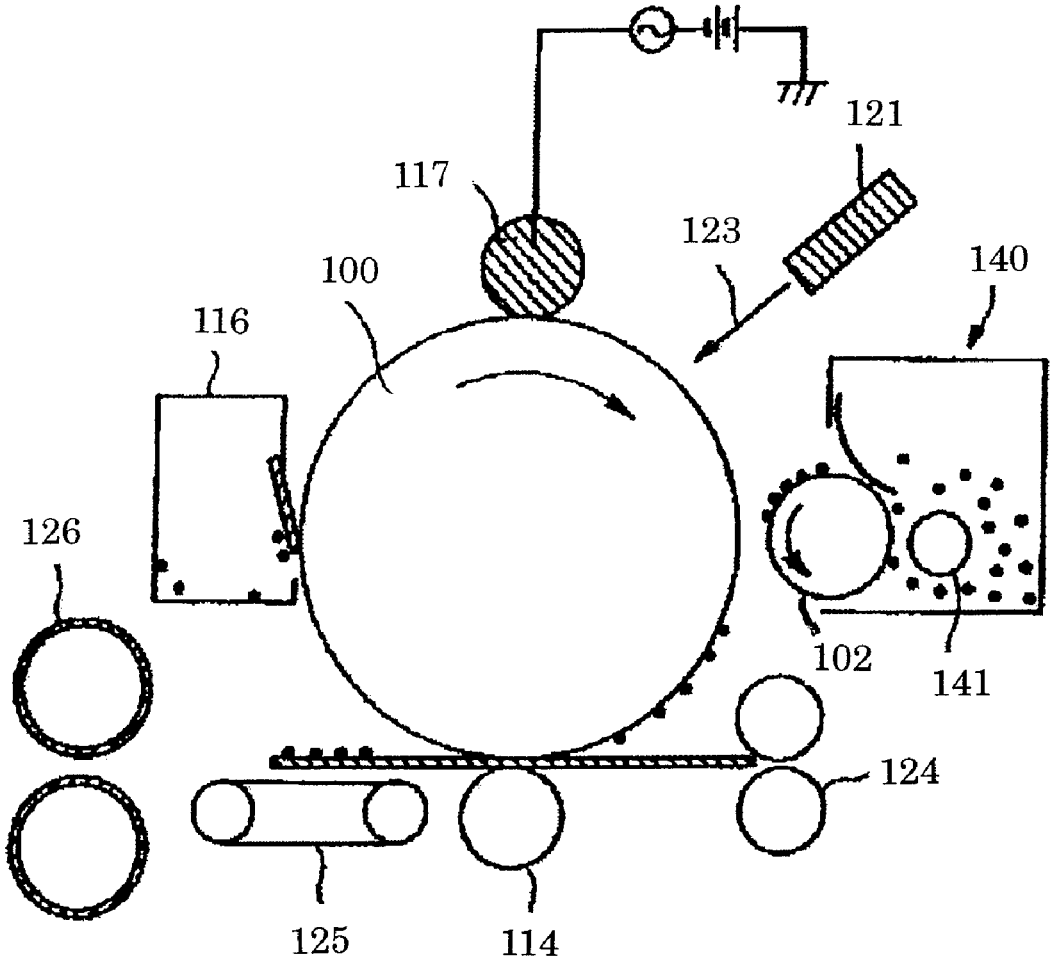
FIG. 1 is a diagrammatic sectional view showing an example of an image forming apparatus in which the magnetic toner of the present invention may preferably be used.

The present inventors have advanced their studies on constituent materials and production methods concerned with toners, and have discovered that the ratio of the value of activation energy (Ea) at 120° C. to the value of activation energy (Eb) at 150° C. of a toner may be so controlled as to be $1.00 \leqq Ea/Eb < 1.20$ and the value of Eb, 110 kJ/mol or less, and this enables the toner to be improved in low-temperature fixing performance to paper and low-temperature anti-offset properties and also to prevent fixing member contamination such as pressure roller staining and further prevent image defects such as density non-uniformity even during printing on many sheets.

In general, the activation energy is known to be the energy that is necessary when a substance goes from the ground state into the transition state, and, in the case of the present invention, is considered to be the energy that is necessary for the toner (toner particles) to change in state. More specifically, it is considered that, the lower activation energy a toner has, the more the toner particles tend to deform because of heat or physical energy, and on the other hand the higher activation energy a toner has, the larger energy the toner particles require to deform, i.e., structurally the more difficult to deform the toner particles are.

Accordingly, the present inventors have made extensive studies. As the result, they have discovered that the activation energy Ea may be controlled to be 110 kJ/mol or less and this is very advantageous for the low-temperature fixing performance. This shows that the toner may require small thermal energy and physical energy for its particle deformation, thus its activation energy may be controlled to be kept low and this enables the toner to enjoy a good low-temperature fixing performance. In addition, in such a toner, the toner has been kept from its staining to a fixing roller, and thereby can also be kept from its staining to a pressure roller. Further, even where the fixing temperature has lowered because of continuous paper feed and so forth, good fixing can be performed without dependence on some differences in fixing temperature. They have discovered these.

Under the controlling of the activation energy Ea to be 110 kJ/mol or less, the activation energies Ea and Eb are set to be in a ratio of $1.00 \leqq Ea/Eb < 1.20$. This enables achievement of much better low-temperature fixing performance and low-temperature anti-offset properties and also enables formation of images having superior image uniformity within the plane of a recording material to which toner images are transferred.

On the other hand, that the value of Ea/Eb is smaller than 1.00 shows that, although the Eb is higher energy than the Ea in the ground state, a toner requires a large energy when it goes into the transition state. Usually, in a substance like the toner resin, the value of Ea/Eb is less apt to become smaller than 1.00. If the value of Ea/Eb is 1.20 or more, the activation energy has so large dependence on the temperature that the toner resin may come to unevenly stand melted, because of changes in fixing temperature between the upper end portion and the lower end portion of a transfer material, to cause faulty fixing or faulty images such as image non-uniformity, undesirably.

How to measure the activation energy specifically is described below.

As a measuring instrument, a rotary flat-plate rheometer ARES (trade name; manufactured by TA Instruments) is used as a measuring instrument. A disklike sample of 25 mm in diameter and 2.0±0.3 mm in thickness, prepared by pressure-molding the toner at 25° C. by means of a tablet press, is used as a measuring sample. The sample is fitted to parallel plates, and is heated to 100° C. from room temperature (25° C.) over a period of 15 minutes, where, after the disk has been adjusted in shape, the measurement is started. In particular, it is important for the sample to be so set that the normal force comes to 0 at the initial stage.

During the measurement after that, any effect of the normal force may be cancelled as described below, by placing the auto tension adjustment in the on state.

The activation energy is measured under the following conditions.

1. Parallel plates of 25 mm in diameter are used.
2. Frequency is set at 0.1 Hz (initial) and 100 Hz (final).
3. Applied-strain initial value is set to be 0.1%.
4. Measurement is started setting start temperature at 100° C., end temperature at 160° C., heating steps at 10° C., and retention time (soak time) for 1 minute.

In the measurement, an auto adjustment mode is set under the following conditions. An auto tension adjustment mode is employed in the measurement.

5. Auto tension direction is set to be "compression".
6. Initial static force is set to be 0 g, and auto tension sensitivity, 10.0 g.
7. Conditions under which the auto tension is operated are those where the sample modulus is smaller than $1.0\times10^6$ (Pa).

Master curves are prepared from storage elastic modulus G' within the ranges of from 0.1 Hz to 100 Hz and from 100° C. to 160° C., measured in the above way. In the present invention, a master curve is prepared setting as one reference temperature the 150° C. that is close to the fixing temperature on paper at the time of fixing. Further, supposing the temperature on fixing sheet materials that comes when the fixing temperature varies because of continuous paper feed, use of cardboard, and so forth, 120° C. is set as a reference temperature to prepare another master curve. About how to shift the temperature, "two-dimensional minimization" is chosen in order to make optimization by length-breadth shifting. As a calculation method, "guess mode" is chosen so as to calculate the slant of the shift factor in preference. Further, the activation energy is calculated from an Arrhenius plot in which the logarithm of a shift factor aT obtained when the master curve is prepared is plotted as ordinate and the reciprocal of measured temperature T on that occasion is plotted as abscissa.

Where the insoluble matter due to a binder resin component that is extracted by Soxhlet extraction made using tetrahydrofuran (THF) is represented by A (%), the Ea and the A may preferably be in a ratio of $1.0 \leqq Ea/A \leqq 5.0$, more preferably $1.0 \leqq Ea/A \leqq 4.0$, and still more preferably $2.0 \leqq Ea/A \leqq 3.0$.

Toner particles deform at the time of fixing, where it is considered important for them to have elasticity in order to achieve good release properties.

Think about the elasticity of toner particles. A component insoluble in THF (such a component is hereinafter also termed a gel component) is considered to have a higher elasticity than a soluble matter because the former has a high cross-link density to form a strong entanglement of molecular chains. Making such an insoluble matter present in the binder resin in a large quantity enables achievement of high release properties and high-temperature anti-offset properties and good storage stability. Usually, however, a high elasticity comes when the gel component is present in a large quantity, and hence a difficulty may come about in low-temperature fixing. Accordingly, in the present invention, the cross-link density and molecular-chain entanglement are so controlled as to be in a mild condition to make more flexible the branched chains that form the cross-linkage, thus a soft gel is formed which has both elasticity and plasticity. The toner satisfying the above $1.0 \leqq Ea/A \leqq 5.0$ is a toner containing such a soft gel, and can be kept from its staining to the pressure roller and have superior low-temperature fixing performance, low-temperature and high-temperature anti-offset properties and storage stability.

In medium- or low-speed laser beam printers suitable for SOHO and personal use, fixing is performed at a light pressure in many cases, where pressure may be applied to the toner on the transfer material with difficulty to tend to cause offset especially at the time of low-temperature fixing. Hence, the toner is required to be improved not only in the above thermal stability and low-temperature fixing performance but also in pressure roller anti-staining properties and low-temperature anti-offset properties. Then, the toner particles are required to be readily deformable by heat energy and also have elasticity for achieving high release properties.

Here, think about the gel component. In general, a high-molecular component that can make a gel forms cross-linkage between molecules. Hence, making longer the distance between cross-link points enables formation of what is called a sparse gel. A cross-linked structure having such a long distance between cross-link points can not easily make any unnecessarily strong gel, and tends to make a readily deformable component to tend to make a component which is readily deformable for the energy applied.

Such a gel structure also has in its cross-link chain a moiety different from carbon-carbon bonds, as exemplified by carbon-oxygen bonds, and this makes the gel more highly deformable for the energy applied. Such a structure may include as an example thereof a structure containing a functional group, like an ether linkage contained in a carbon chain.

As a cross-linking agent, a compound chiefly having two or more polymerizable double bonds may be used, as exemplified by aromatic divinyl compounds such as divinyl benzene and divinyl naphthalene; carboxylates having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; any of which may be used alone or in the form of a mixture.

In the present invention, in order to form the soft gel, it is preferable for the cross-linked structure to be so controlled as to be sparse. In order to obtain a structure which has a long distance between cross-link points and is flexible, such a cross-linking agent as one represented by the following general formula is preferred, which has a straight-chain structure between polymerizable double bonds.

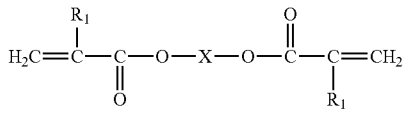

wherein $R_1$ represents a hydrogen atom or a methyl group; and X represents a straight-chain alkyl group having 4 to 10 carbon atoms or a straight-chain alkyl ether group having 6 to 20 carbon atoms, which contains an ether structure in its chain.

For example, a cross-linking agent having a structure as shown below is preferred.

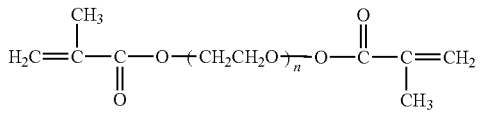

$n = 4$ to 10

The polymerizable double bonds the cross-linking agent has may preferably be in a number of two, in order to obtain a mild cross-linked structure.

When the magnetic toner of the present invention is produced by polymerization, it is important to control the make-up and quantity of the THF-insoluble matter. The cross-linking agent may preferably be added in an amount of from 0.001 to 15 parts by mass, more preferably from 0.01 to 10 parts by mass, and still more preferably from 0.05 to 5 parts by mass, based on 100 parts by mass of the polymerizable monomer, which amount depends on the type of the cross-linking agent.

In order to keep the gel structure from being too much strong, in the step of polymerization reaction, the temperature may preferably be controlled to be from 40° C. or more to 70° C. or less, more preferably from 50° C. or more to 70° C. or less, and still more preferably from 50° C. or more to 60° C. or less, for 1 hour at the initial stage of the reaction.

The reaction is kept mild at the reaction initial stage where the reaction is considered to take place most actively, whereby the gel the molecular chains stand entangled too much strongly can be kept from being formed, and a gel structure can be formed which is flexible and has a low activation energy.

The THF-insoluble matter A (%) due to the binder resin in the toner may preferably be contained in the binder resin in an amount of from 5% to 50%, more preferably from 10% to 45%, and still more preferably from 15% to 40%.

Inasmuch as the THF-insoluble matter is in the amount within the above range, a toner can be obtained which shows appropriate structural changes for heat and has good uniform fixing performance, and the pressure roller staining and high-temperature offset can be kept from occurring. In addition, any release agent may appropriately come to exude from toner particles at the time of fixing to enable achievement of both the low-temperature fixing performance and the low-temperature anti-offset properties.

The THF-insoluble matter of the binder resin of the toner is measured in the following way.

The toner is precisely weighed in an amount of 1 g, which is then put in a cylindrical filter paper and is subjected to Soxhlet extraction for 16 hours using 200 ml of THF. Thereafter, the cylindrical filter paper is taken out, and then vacuum-dried at 40° C. for 20 hours to measure the weight of residues. The THF-insoluble matter is calculated according to Expression (4) below. In the measurement of the THF-insoluble matter, whether or not toner contents such as a magnetic material, a charge control agent, a release agent, external additives and a pigment are soluble or insoluble in THF is taken into account, and the THF-insoluble matter on the basis of the binder resin is calculated.

$$\text{THF-insoluble matter (\%)} = [(W2 - W3)/(W1 - W3 - W4)] \times 100 \quad (4)$$

wherein W1 is the mass of toner; W2 is the mass of residues; W3 is the mass of THF-insoluble matter, other than the binder resin; and W4 is the mass of THF-soluble matter, other than the binder resin.

The component soluble in THF (THF-soluble matter) at room temperature 23° C. may preferably have a peak molecular weight of from 15,000 or more to 40,000 or less, more preferably from 17,000 or more to 30,000 or less, and still more preferably from 18,000 or more to 25,000 or less, as measured by gel permeation chromatography (GPC) of that component. Having the molecular weight within this range is preferable because the soft gel and the soluble matter can be formed in quantities controlled to be optimum and the toner can have the low-temperature fixing performance, the low-temperature and high-temperature anti-offset properties and the storage stability all together.

Molecular weight distribution of the THF-soluble matter of the toner may be measured by gel permeation chromatography (GPC) in the following way.

First, the toner is dissolved in tetrahydrofuran (THF) at room temperature 23° C. over a period of 24 hours. Then, the solution obtained is filtered with a solvent-resistant membrane filter of 0.2 μm in pore diameter to make up a sample solution. Here, the sample solution is so adjusted that the component soluble in THF is in a concentration of about 0.8% by mass. Using this sample solution, the measurement is made under the following conditions.

Apparatus: HLC8120 GPC (detector: RI) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (e.g., TSK Standard Polystyrene F-850, F-450, F-288, F-128, F-80, F-40, F-20, F-10, F-4, F-2, F-1, A-5000, A-2500, A-1000, A-500; available from Tosoh Corporation).

The magnetic toner of the present invention may preferably have an average circularity of 0.950 or more, and more preferably 0.960 or more. This is because the toner particles may uniformly be pressured at the time of fixing to afford superior fixing area uniformity. In addition, even in running operation, such a toner can not easily cause a lowering of fluidity and can not easily cause a decrease in image density.

In the present invention, in order to obtain images faithful to latent images for the purpose of making image quality higher, the magnetic toner may also preferably have a weight-average particle diameter (D4) of from 3.0 μm to 10.0 μm, and more preferably from 4.0 μm to 9.0 μm.

As long as the toner has the weight-average particle diameter (D4) within the above range, it can achieve a good transfer efficiency and also can have appropriate fluidity and agitatablility, thus individual toner particles can be charged in a closely uniform state. Further, such a toner can keep spots from occurring around character or line images and facilitates achievement of high resolution.

The magnetic toner of the present invention may also preferably have a ratio of weight-average particle diameter (D4) to number-average particle diameter (D1), D4/D1, of 1.40 or less, and more preferably 1.35 or less. Inasmuch as the ratio of D4/D1 is within the above range, the heat and pressure to be applied to the toner can be improved in their uniformity, and also the toner can have a sharp charge quantity distribution, favorably.

As a process for producing the magnetic toner of the present invention, suspension polymerization is preferred. In the case when the toner is produced by suspension polymerization, the ratio of D4/D1 may be controlled by the uniformity in treatment of the magnetic material used, the degree of hydrophobicity, the amount of the magnetic material and the conditions for granulation (the type of a dispersing agent, how to effect granulation, and granulation time).

Here, the average particle diameter and particle size distribution of the toner may be measured by various methods making use of Coulter Counter Model TA-II or Coulter Multisizer (manufactured by Coulter Electronics, Inc.). In the present invention, Coulter Multisizer (manufactured by Coulter Electronics, Inc.) is used. An interface (manufactured by Nikkaki Bios Co.) that outputs number distribution and volume distribution and a personal computer PC9801 (manufactured by NEC Corporation) are connected. As an electrolytic solution, an aqueous 1% NaCl solution is used which is prepared using first-grade sodium chloride. For example, ISOTON R-II (available from Coulter Scientific Japan Co.) may be used as the electrolytic solution.

As a specific measuring method, 5 ml of a surface active agent, preferably an alkylbenzene sulfonate, is added as a dispersant to 100 ml of the aqueous electrolytic solution, and further 10 mg of a sample to be measured is added. The electrolytic solution in which the sample has been suspended is subjected to dispersion treatment for about 1 minute in an ultrasonic dispersion machine. The volume distribution and number distribution are calculated by measuring the volume and number of toner particles of 2 μm or more in particle diameter by means of Coulter Multisizer, using an aperture of 100 μm as its aperture. Then the weight-average particle diameter (D4) and the number-average particle diameter (D1) are determined. In Examples given later as well, these are measured in the same way.

In the magnetic toner of the present invention, in order to effectively bring out the performance of the soft gel contained in the binder resin, it is also preferable to control the state of presence of the magnetic material in the binder resin.

Stated specifically, where the magnetic toner is dispersed in 5 mol/l of hydrochloric acid, the proportion Sc of the amount of extraction from the toner for an extraction time of from 3 minutes to 15 minutes ($S_{3-15}$) to the amount of extraction from the toner for an extraction time of from 15 minutes to 30 minutes ($S_{15-30}$), i.e., $S_{3-15}/S_{15-30}$, satisfies Expression (3):

$$1.2 \leqq Sc \leqq 10.0 \quad (3).$$

Where the magnetic toner has been added to 5 mol/l of hydrochloric acid, components soluble in hydrochloric acid which are present in toner particles are extracted therefrom into the hydrochloric acid. In the magnetic toner like that which contains a magnetic iron oxide as the magnetic material, a chief component extracted with the hydrochloric acid is the magnetic iron oxide. Where the other components used such as a charge control agent and a colorant are soluble in the hydrochloric acid, these are also extracted. However, usually the magnetic iron oxide magnetic iron oxide is in a very larger content than the other components, and hence the component extracted is almost what comes from the magnetic iron oxide.

Hence, at a point of time where the extraction time is 3 minutes, the magnetic material present at the outermost surface portions of toner particles is dissolved to come extracted therefrom into the hydrochloric acid. At a point of time where the extraction time is 15 minutes, the magnetic material present in the interiors of toner particles comes extracted, and, at a point of time where the extraction time is 30 minutes, the magnetic material present in the further interiors of toner particles comes extracted. Thus, the time for which the magnetic material is dissolved with the hydrochloric acid may be changed, and this enables presumption of the state of presence of the magnetic material in the toner particles at their portions of from outermost surfaces to interiors.

In the magnetic toner of the present invention, it is preferable that components other than the magnetic material, such as resin, stand localized at the toner particle center portions and the magnetic material is present one-sidedly to the vicinities of toner particle surfaces. In such a case, the toner particles are more highly thermally conductive than a case in which the magnetic material stands wholly dispersed therein, thus the heat at the time of fixing may quickly be conducted anywhere to the interiors of, and across, individual particles, promising a high uniformity in heat.

This is because, when heat energy is conducted to the toner particles at the time of fixing, the conduction of heat is superior where the highly thermally conductive substance is present one-sidedly as above.

That is, where the resin and the magnetic material have a difference in thermal conductivity between them as in the toner making use of the magnetic material, it is considered that the presence of the magnetic material in the binder resin in a dispersed state hinders any smooth heat conduction to damage the uniformity in the conduction of heat between the resin and the magnetic material in the toner particles, and that this is disadvantageous to an aim of achieving the level of particle deformation that is uniform and also corresponds to the energy applied.

In the case when, as described above, the proportion Sc of the amount of extraction from the toner is within the above range, the magnetic material brings a covering effect in the vicinities of toner particles, also promising a superior stability to any environmental variations. In addition, the release agent may appropriately come to exude to toner particle surfaces at the time of fixing to enable achievement of a better low-temperature fixing performance and also enable improvement in anti-staining to the fixing member.

The extraction of iron from the toner by the aid of hydrochloric acid is carried out in the following way. In an environment of normal temperature (23° C.), 25 mg of the toner is added to 100 ml of 5 mol/l hydrochloric acid to extract iron while stirring these by means of a stirrer. Upon lapse of a stated time, a test fluid is sampled and then the toner is filtered out of it. Thereafter, the absorption of the resultant fluid is measured at a wavelength of 338 nm to determine the concentration of iron.

As a magnetic toner production process that is preferable to the controlling of toner particle structure as described above, a process is preferred in which the toner particles are produced in an aqueous medium. It may include, e.g., a suspension polymerization process in which a polymerizable monomer composition is directly polymerized in an aqueous medium to obtain toner particles. In such suspension polymerization, the difference in affinity between the composition and the aqueous medium may be utilized to control the localization/separation of polar and non-polar components.

However, commonly available magnetic materials have so poor a dispersibility in polymerizable monomers that, if the toner particles are produced by such suspension polymerization using such a magnetic material, toner particles containing the magnetic material in a large quantity or toner particles in which the magnetic material is little present may come about, resulting in non-uniform quantity of the magnetic material in the toner particles. Then, this makes it difficult to control the toner particle structure as in making the magnetic material and the binder resin dispersed unevenly in the toner particles, resulting in a great lowering of not only the desired low-temperature fixing performance and low-temperature anti-offset properties but also the chargeability of the toner. Further, because of a strong mutual action between the magnetic material and the water in producing the suspension polymerization toner, it is difficult to obtain the toner having the average circularity of 0.950 or more, and further the toner may have a broad particle size distribution.

These phenomena come about because the magnetic material is commonly hydrophilic, and come from the fact that the magnetic material concentrates at droplet surfaces when the toner particles are produced by the suspension polymerization. In order to resolve such problems, it is important to modify surface properties the magnetic material may have.

Accordingly, it is preferable for the magnetic material used in the magnetic toner of the present invention to have been subjected to uniform hydrophobic treatment with a treating agent. When particle surfaces of the magnetic material are made hydrophobic, it is very preferable to use a method which makes surface treatment in an aqueous medium while dispersing the magnetic material so as to have a primary particle diameter and hydrolyzing a treating agent. This method of hydrophobic treatment may less cause any mutual coalescence of magnetic material particles than any treatment made in a gaseous phase, and also makes charge repulsion act between magnetic material particles themselves as a result of the hydrophobic treatment, so that the magnetic material particles are surface-treated substantially in the state of primary particles.

The method of surface-treating the magnetic material particles while hydrolyzing the treating agent in an aqueous medium does not require any use of treating agents which may generating gas, such as chlorosilanes and silazanes. It also enables use of highly viscous treating agents which have hitherto tended to cause mutual coalescence of magnetic material particles in a gaseous phase and hence have ever made it difficult to make good treatment. Thus, a great effect of making hydrophobic is obtainable.

The treating agent usable in the particle surface treatment of the magnetic toner according to the present invention may include, e.g., silane coupling agents and titanium coupling agents.

Preferably usable are silane coupling agents, which are those represented by the general formula (I):

$$R_mSiY_n \quad (I)$$

wherein R represents an alkoxyl group; m represents an integer of 1 or more to 3 or less; Y represents a hydrocarbon group such as an alkyl group, a vinyl group, a glycidoxyl group or a methacrylic group; and n represents an integer of 1 or more to 3 or less, provided that m+n=4.

The silane coupling agents represented by the general formula (I) may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, hyroxypropyltrimethoxysilane, n-hexadecyltrimethoxysilane and n-octadecyltrimethoxysilane.

Of these, it is more preferable to use an alkyltrialkoxysilane compound represented by the following general formula (2).

$$C_pH_{2p+1}—Si—(OC_qH_{2q+1})_3 \quad (II)$$

wherein p represents an integer of 2 or more to 20 or less, and q represents an integer of 1 or more to 3 or less.

In the above formula, if the p is smaller than 2, though the hydrophobic treatment may be made with ease, it is difficult to provide a sufficient hydrophobic nature, making it difficult to control the coming-bare of the magnetic material to the magnetic toner particles, or the liberation of the latter from the former. If on the other hand the p is larger than 20, though hydrophobic nature can be sufficient, the magnetic-material particles may greatly coalesce one another to make it difficult to disperse the magnetic material sufficiently in the toner particles. The use of the above treating agent makes the magnetic material makes appropriately improved in hydrophobic nature, and makes it improved in hydrophobic nature while keeping its affinity for the aqueous system that it is a medium. This enables the magnetic material to be so controlled as to come present in the vicinities of the toner particle surfaces.

If the q is larger than 3, the silane compound may have a low reactivity to make it difficult for the magnetic material to be made sufficiently hydrophobic. In particular, it is preferable to use an alkyltrialkoxysilane compound in which the p in the formula represents an integer of 2 or more to 20 or less (more preferably an integer of 3 or more to 15 or less, and still more preferably an integer of 4 or more to 8 or less) and the q represents an integer of 1 or more to 3 or less (more preferably an integer of 1 or 2).

The silane compound used may preferably be in a total treatment quantity of from 0.05 part by mass or more to 20 parts by mass or less, and more preferably from 0.1 part by mass or more to 10 parts by mass or less, based on 100 parts by mass of the magnetic material. It is preferable for the quantity of the treating agent to be adjusted depending on the particle surface area of the magnetic toner, the reactivity of the treating agent, and so forth.

In order to obtain the effect of the present invention sufficiently, it is important to make the magnetic material present one-sidedly to the vicinities of toner particle surfaces. Hence, the p in the formula may preferably be 3 or more to 10 or less and the treatment quantity may preferably be from 0.1 part by mass or more to 5 parts by mass or less. To make hydrophobic treatment in an aqueous medium as the particle surface treatment of the magnetic material, a method is available in which the magnetic material and treating agent in suitable quantities are stirred in the aqueous medium. Such stirring may preferably be carried out by using a mixer or the like having a stirring blade and be so carried out that the magnetic material particles may come to be primary particles in the aqueous medium.

Herein, the aqueous medium refers to a medium composed chiefly of water. Stated specifically, the aqueous medium may include water itself, water to which a surface-active agent has been added in a small quantity, water to which a pH adjuster has been added, and water to which an organic solvent has been added. As the surface-active agent, a nonionic surface-active agent such as polyvinyl alcohol is preferred.

The surface-active agent may be added in an amount of from 0.1% by mass or more to 5% by mass or less, based on the water. The pH adjuster may include inorganic acids such as hydrochloric acid. The organic solvent may include alcohols.

In the magnetic material thus hydrophobic-treated, no agglomeration of particles is seen and the surfaces of individual particles have uniformly been hydrophobic-treated. Hence, when used as a material for the polymerization toner, the toner particles can have a good uniformity The magnetic material used in the magnetic toner of the present invention may contain any of elements such as phosphorus, cobalt, nickel, copper, magnesium, manganese, aluminum and silicon. The magnetic material is also chiefly composed of an iron oxide such as triiron tetraoxide or γ-iron oxide. Any of these may be used alone or in combination.

Any of these magnetic material may preferably have a BET specific surface area, as measured by nitrogen gas absorption, of from 2 to 30 $m^2/g$, and particularly from 3 to 28 $m^2/g$, and also may preferably have a Mohs hardness of from 5 to 7. As the particle shape of the magnetic material, it may be, e.g., polygonal larger than octahedral, or octahedral, hexahedral, spherical, acicular or flaky. Polygonal larger than octahedral, or octahedral, hexahedral or spherical ones are preferred as having less anisotropy, which are preferable in order to improve image density. Such particle shapes of the magnetic material may be ascertained by SEM or the like.

The magnetic material may preferably have a volume-average particle diameter of from 0.05 μm to 0.40 μm, and more preferably from 0.10 μm to 0.30 μm.

Inasmuch as the magnetic material has volume-average particle diameter within the above range, it can give a sufficient blackness as a colorant, and also is well dispersible in the toner particles.

The volume-average particle diameter of the magnetic material may be measured with a transmission electron microscope. Stated specifically, toner particles to be observed are well dispersed in epoxy resin, followed by curing for 2 days in an environment of temperature 40° C. to obtain a cured product, which is then cut out in slices by means of a microtome to prepare a sample, where the particle diameter of 100 magnetic material particles in the visual field is measure on a photograph taken at 10,000 to 40,000 magnifications using a transmission electron microscope (TEM). Then, the volume-average particle diameter is calculated on the basis of circle-equivalent diameter equal to the particle projected area of the magnetic material. It is measured in the same way also in Examples given later.

In the present invention, in addition to the magnetic material, other colorant may also be used in combination. Such a colorant usable in combination may include magnetic or non-magnetic inorganic compounds and known dyes and pigments. Stated specifically, it may include, e.g., ferromagnetic metal particles of cobalt, nickel and or the like, or particles of alloys of any of these metals to which chromium, manganese, copper, zinc, aluminum, a rare earth element or the like has been added; as well as particles of hematite, titanium black, nigrosine dyes or pigments, carbon black, and phthalocyanines. These may also be used after their particle surface treatment.

The magnetic material may preferably have a degree of hydrophobicity of from 35% or more to 90% or less, and more preferably from 40% or more to 80% or less. The degree of hydrophobicity is arbitrarily changeable depending on the type and amount of the agent for treating the magnetic material particle surfaces. The degree of hydrophobicity shows how hydrophobic the magnetic material is, and it means that a material having a low degree of hydrophobicity has a high hydrophilicity. Inasmuch as the magnetic material has the degree of hydrophobicity within the above range, it comes to be better dispersible in polymerizable monomers when the tone is produced by suspension polymerization. In addition, as long as the magnetic material has the degree of hydrophobicity like this, it can be treated in a high uniformity between particles of the magnetic material.

The degree of hydrophobicity in the present invention is what is measured by the following method. The degree of hydrophobicity of the magnetic material is measured by a methanol titration test. The methanol titration test is an experimental trial by which the degree of hydrophobicity of a magnetic material having particle surfaces having been made hydrophobic is ascertained.

The measurement of the degree of hydrophobicity by the use of methanol is made in the following way. 0.1 g of the magnetic material is added to 50 ml of water held in a beaker of 250 ml in volume. Thereafter, to the resultant liquid mixture, methanol is slowly added to carry out titration. Here, the titration is carried out while feeding the methanol from the bottom of the liquid mixture and stirring them slowly. The magnetic material is deemed to have finished settling at a point of time where any suspended matter has come no longer to be seen on the liquid surface, and the degree of hydrophobicity is expressed as volume percentage of the methanol in the liquid mixture of methanol and water that is formed when the magnetic material has finished settling. It is measured in the same way also in Examples given later.

The magnetic material may preferably be used in an amount of from 10 parts by mass or more to 200 parts by mass or less, and more preferably from 20 parts by mass or more to 180 parts by mass or less, based on 100 parts by mass of the binder resin. Inasmuch as the magnetic material is in a content within the above range, a toner having a sufficient coloring power is obtainable, and also better developing performance and fixing performance are achievable.

The content of the magnetic material in the toner may be measured with a thermal analyzer TGA7, manufactured by Perkin-Elmer Corporation. As a measuring method, the toner is heated at a heating rate of 25° C./minute from normal temperature to 900° C. in an atmosphere of nitrogen. The mass of weight loss in the course of from 100° C. to 750° C. is regarded as the mass of the component excluding the magnetic material from the toner, and the residual mass is regarded as the magnetic-material weight.

The magnetic material usable in the present invention may be, in the case of magnetite for example, produced in the following way. To an aqueous ferrous salt solution, an alkali such as sodium hydroxide is added in an equivalent weight, or more than equivalent weight, with respect to the iron component to prepare an aqueous solution containing ferrous hydroxide. Into the aqueous solution thus prepared, air is blown while its pH is maintained at pH 7 or above (preferably a pH of 8 or more to 14 or less), and the ferrous hydroxide is made to undergo oxidation reaction while the aqueous solution is heated at 70° C. or more to firstly form seed crystals serving as cores of magnetic ion oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 6 or more to 14 or less and air is blown, to cause magnetic iron oxide particles to grow about the seed crystals as cores. With progress of oxidation reaction, the pH of the liquid comes to shift to acid side, but the pH of the liquid is so adjusted as not to be made less than 6. At the termination of the oxidation reaction, the pH is adjusted, and the liquid is thoroughly stirred so that the magnetic iron oxide particles become primary particles. Then the treating agent is added, and the mixture obtained is thoroughly mixed and stirred, followed by filtration, drying, and then light disintegration to obtain magnetic iron oxide particles having been hydrophobic-treated. Instead, the iron oxide particles obtained after the oxidation reaction is completed, followed by washing and filtration, may be again dispersed in a different aqueous medium without drying, and thereafter the pH of the dispersion again formed may be adjusted, where a silane coupling agent may be added with thorough stirring, to make coupling treatment.

As the ferrous salt, it is possible to use iron sulfate commonly formed as a by-product in the manufacture of titanium by the sulfuric acid method, or iron sulfate formed as a by-product as a result of surface washing of steel sheets, and is also possible to use iron chloride or the like. In the process of producing the magnetic iron oxide by the aqueous solution method, in order to, e.g., prevent viscosity from increasing at the time of reaction, an aqueous iron sulfate solution is used in an iron concentration of from 0.5 mol/l or more to 2 mol/l or less. Commonly, the lower the concentration of iron sulfate is, the finer particle size the products tend to have. Also, in the reaction, the more the air is and the lower the reaction temperature is, the finer particles tend to be formed.

The use of the magnetic toner having as a material the hydrophobic magnetic material produced in this way enables the toner to achieve a stable chargeability and to achieve a high transfer efficiency, a high image quality and a high stability.

The magnetic toner of the present invention may preferably be a magnetic toner having a value of magnetization of from 10 to 50 $\mu m^2/kg$ (emu/g) in a magnetic field of 79.6 kA/m (1,000 oersteds). As long as the toner has the value of magnetization within the above range, not only good transport performance and agitation performance are achievable, but also the toner can well be kept from scattering. In addition, the toner can be kept from leaking from the developing assembly, and also any transfer residual toner can be collected in an improved efficiency.

The magnetic material may also preferably have a magnetization intensity of from 30 $\mu m^2/kg$ or more to 120 $\mu m^2/kg$ or less in a magnetic field of 796 kA/m.

The magnetization intensity of the toner is arbitrarily changeable depending on the quantity of the magnetic material to be contained and the saturation magnetization of the magnetic material.

In the present invention, the intensity of saturation magnetization of the magnetic toner is measured with a vibration type magnetice-force meter VSM P-1-10 (manufactured by Toei Industry, Co., Ltd.) under application of an external magnetic field of 79.6 kA/m at room temperature of 25° C. Magnetic properties of the magnetic material may also be measured with the vibration type magnetic-force meter VSM P-1-10 (manufactured by Toei Industry, Co., Ltd.) under application of an external magnetic field of 796 kA/m at room temperature of 25° C.

The magnetic toner according to the present invention may also be produced by a method in which a molten mixture is atomized in the air by means of a disk or a multiple fluid nozzle to obtain spherical toner particles; a dispersion polymerization method in which toner particles are directly produced using an aqueous organic solvent capable of dissolving polymerizable monomers and not capable of dissolving the resulting polymer; or an emulsion polymerization method as typified by soap-free polymerization in which toner particles are produced by direct polymerization in the presence of a water-soluble polar polymerization initiator.

The magnetic toner of the present invention may preferably contain a release agent in order to improve its fixing performance, and may preferably contain it in an amount of from 1 part by mass or more to 30 parts by mass or less, and more preferably from 3 parts by mass or more to 25 parts by mass or less, based on the mass of the binder resin. As long as the release agent is in a content within the above range, the effect to be brought by its addition is well obtainable and at the same time the fluidity and storage stability of the toner can be kept from lowering.

The release agent usable in the magnetic toner according to the present invention may include petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

Of these release agents, those having a maximum endothermic peak temperature of from 40° C. to 110° C. in a DSC curve as measured with a differential scanning calorimeter are preferred, and those having that of from 45° C. to 90° C. are more preferred.

More specifically, inasmuch as the release agent has a maximum endothermic peak temperature within the above temperature range, the effect for low-temperature fixing, releasability and storage stability is obtainable. Further, in the case when the granulation and polymerization are carried out in an aqueous medium to obtain the toner particles directly by polymerization, it may by no means lower the granulation performance.

The maximum endothermic peak temperature of the release agent is measured according to ASTM D3418-8. For the measurement, for example, DSC-7 is used, which is manufactured by Perkin-Elmer Corporation. The temperature at the detecting portion of the instrument is corrected on the basis of melting points of indium and zinc, and the amount of heat is corrected on the basis of heat of fusion of indium. A pan made of aluminum is used for a sample for measurement, and an empty pan is set as a control. A DSC curve is used which is measured when the sample is heated once up to 200° C. and, after heat history is removed, cooled rapidly, then again heated at a heating rate of 10° C./min in the temperature range of from 30° C. to 200° C. The measurement is made in the same way also in Examples given later.

Molecular weight of the resin component soluble in THF may be measured in the following way. A solution prepared by dissolving the toner in THF by leaving these to stand at a room temperature for 24 hours is filtered with a solvent-resistant membrane filter of 0.2 μm in pore diameter to make up a sample solution, and the measurement is made under the following conditions. Here, in preparing the sample solution, it is so adjusted that the component soluble in THF is in a concentration of from 0.4% by mass to 0.6% by mass.

Apparatus: High-speed GPC HLC8120 GPC (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: THF.

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (TSK Standard Polystyrene F-850, F-450, F-288, F-128, F-80, F-40, F-20, F-10, F-4, F-2, F-1, A-5000, A-2500, A-1000, A-500; available from Tosoh Corporation).

The magnetic toner of the present invention may be mixed with a charge control agent in order to make charge characteristics stable. As the charge control agent, any known charge control agent may be used. In particular, charge control agents which have a high charging speed and also can stably maintain a constant charge quantity are preferred. Further, in the case when the magnetic toner particles are directly produced by polymerization, particularly preferred are charge control agents having a low polymerization inhibitory action and substantially free of any solubilizate to the aqueous dispersion medium. As specific compounds, they may include, as negative charge control agents, metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; polymer type compounds having sulfonic acid or carboxylic acid in the side chain; as well as boron compounds, urea compounds, silicon compounds, and carixarene. As positive charge control agents, they may include quaternary ammonium salts, polymer type compounds having such a quaternary ammonium salt in the side chain, guanidine compounds, Nigrosine compounds and imidazole compounds.

As methods for making the toner contain the charge control agent, a method of adding it internally to the toner particles and a method of adding it externally to the same are available. The quantity of the charge control agent to be used depends on the type of the binder resin, the presence of any other additives, and the manner by which the toner is produced, inclusive of the manner of dispersion, and can not absolutely be specified. When added internally, the charge control agent may be used in an amount ranging from 0.1 part by mass to 10 parts by mass, and more preferably from 0.1 part by mass to 5 parts by mass, based on 100 parts by mass of the binder resin. When added externally, it may preferably be added in an amount of from 0.005 part by mass to 1.0 part by mass, and more preferably from 0.01 part by mass to 0.3 part by mass, based on 100 parts by mass of the toner particles.

The addition of the charge control agent is not essential. The triboelectric charging between the toner and the toner layer thickness control member and toner carrying member may intentionally be utilized, and this makes it not always necessary for the toner to contain the charge control agent.

How to produce the toner by the suspension polymerization process is described next. First, to a polymerizable monomer(s) which is to make the binder resin, the magnetic material and optionally a release agent, a plasticizer, a charge control agent, a cross-linking agent, a colorant, and also other additives as exemplified by a high polymer and a dispersing agent are appropriately added, and then uniformly dissolved or dispersed therein by means of a dispersion machine or the like to prepare a polymerizable monomer composition. Thereafter, this polymerizable monomer composition is dropwise added to an aqueous medium containing a dispersion stabilizer, so as to be suspended in the aqueous medium, to polymerize the polymerizable monomer(s) to obtain toner particles.

The polymerizable monomer usable in the production of the polymerization toner may include the following.

The polymerizable monomer may include styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in the form of a mixture. Of the foregoing monomers, styrene or a styrene derivative may preferably be used alone or in the form of a mixture with other monomer, in view of developing performance and running performance of the toner.

In the production of the polymerization toner, the polymerization may be carried out by incorporating a high polymer in the polymerizable monomer composition. For example, a polymerizable monomer component containing a hydrophilic functional group such as an amino group, a carboxylic group, a hydroxyl group, a sulfonic acid group, a glycidyl group or a nitrile group can not be used because it is water-soluble as a monomer and hence dissolves in an aqueous suspension to cause emulsion polymerization. When such a monomer component should be introduced into toner particles, it may be used in the form of a copolymer such as a random copolymer, a block copolymer or a graft copolymer, of any of these with a vinyl compound such as styrene or ethylene, in the form of a polycondensation product such as polyester or polyamide, or in the form of a polyaddition product such as polyether or polyimine. Where the high polymer containing such a polar functional group is made present together in the toner particles, the release agent can be made phase-separated and more strongly enclosed in particles, and hence magnetic toner particles having good anti-blocking properties and developing performance can be obtained.

Of these high polymers, the incorporation of a polyester resin may especially be greatly effective. This is presumed to be for the following reason. The polyester resin contains many ester linkages, which are of structure having a relatively high polarity, and hence the resin itself has a high polarity. On account of this high polarity, a strong tendency that the polyester localizes at droplet surfaces of the polymerizable monomer composition is shown in the aqueous dispersion medium, and the polymerization proceeds in that state kept as it is, until toner particles are formed. Hence, the polyester resin localizes at toner particle surfaces to provide the toner particles with uniform surface state and surface composition, so that the toner can have a uniform chargeability and also, since the release agent can well be enclosed in toner particles, can enjoy very good developing performance in virtue of a cooperative effect of the both.

As the polyester resin, a saturated polyester resin or an unsaturated polyester resin, or the both, may be used under appropriate selection in order to control performances of the toner, such as charging performance, running performance and fixing performance.

As the polyester resin, any conventional one may be used which is constituted of an alcohol component and an acid component. The both components are as exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, a bisphenol derivative represented by the following Formula (I):

(I)

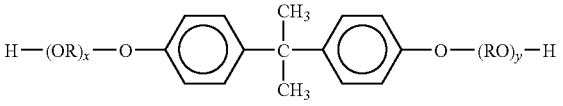

wherein R represents an ethylene group or a propylene group, x and y are each an integer of 1 or more, and an average value of x+y is 2 to 10.

As a dibasic carboxylic acid, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, and also succinic acid or its anhydride substituted with an alkyl group having 6 to 18 carbon atoms or succinic acid or its anhydride substituted with an alkenyl group having 6 to 18 carbon atoms; and unsaturated dicarboxylic acids such as fumaric acid, maleic acid, citraconic acid and itaconic acid, or anhydrides thereof.

The alcohol component may further include polyhydric alcohols such as glycerol, pentaerythritol, sorbitol, sorbitan, and oxyakylene ethers of novolak phenol resins. The acid component may include polycarboxylic acids such as trimellitic acid, pyromellitic acid, 1,2,3,4-butanetetracarboxylic acid, benzophenonetetracarboxylic acid and anhydrides thereof.

As the alcohol component, preferably used is an alkylene oxide addition product of the above bisphenol A, which has superior chargeability and environmental stability and is well balanced in other electrophotographic performances. In the case of this compound, the alkylene oxide may preferably have an average addition molar number of from 2 or more to 10 or less in view of fixing performance and running performance of the toner.

The polyester resin may preferably be composed of from 45 mol % or more to 55 mol % or less of the alcohol component and from 55 mol % or more to 45 mol % or less of the acid component in the whole components.

The polyester resin may preferably have an acid value of from 0.1 mgKOH/g or more to 50 mgKOH/g or less, and more preferably from 5 mgKOH/g or more to 35 mgKOH/g or less, in order for the resin to become present at toner particle surfaces in the magnetic toner of the present invention and for the resultant toner particles to exhibit a stable charging performance.

In the present invention, as long as physical properties of the magnetic toner particles obtained are not adversely affected, it is also preferable to use two or more types of polyester resins in combination or to regulate physical properties of the polyester resin by modifying it with a silicone compound or a fluoroalkyl group-containing compound.

In the case when a high polymer containing such a polar functional group is used, one having a number-average molecular weight of 5,000 or more may preferably be used. As long as it has a number-average molecular weight of 5,000 or more, the effect to be brought by its addition is obtainable without making the toner have low developing performance and anti-blocking properties.

For the purpose of, e.g., improving dispersibility of materials, fixing performance and image characteristics, a resin other than the foregoing may also be added to the monomer composition. Resins usable therefor may include homopolymers of styrene and derivatives thereof, such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins, any of which may be used alone or in the form of a mixture. Any of these may preferably be added in an amount of from 1 part by mass or more to 20 parts by mass or less, based on 100 parts by mass of the polymerizable monomer.

A polymer having a molecular weight different from the range of molecular weight of the toner obtained by polymerizing the polymerizable monomer may further be dissolved to carry out polymerization. This enables production of a toner having a broad molecular weight distribution and high anti-offset properties.

As the polymerization initiator used in the production of the magnetic toner by polymerization, a polymerization initiator is preferred which has a half-life of from 0.5 hour or more to 30 hours or less at the time of polymerization. Such a polymerization initiator used may be added in an amount of from 0.5 part by mass or more to 20 parts by mass or less, based on 100 parts by mass of the polymerizable monomer. Polymerization reaction carried out under such conditions easily enables production of a polymer having a main-peak peak molecular weight in the region of molecular weight of from 5,000 or more to 50,000 or less in GPC.

The polymerization initiator used in the present invention may include conventionally known azo type polymerization initiators and peroxide type polymerization initiators. The azo type polymerization initiators may include 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile. The peroxide type polymerization initiators may include peroxy esters such as t-butyl peroxyacetate, t-butyl peroxylaurate, t-butyl peroxypivarate, t-butyl peroxy-2-ethyl hexanoate, t-butyl peroxyisobutyrate, t-butyl peroxyneodecanoate, t-hexyl peroxyacetate, t-hexyl peroxylaurate, t-hexyl peroxypivarate, t-hexyl peroxy-2-ethyl hexanoate, t-hexyl peroxyisobutyrate, t-hexyl peroxyneodecanoate, t-butyl peroxybenzoate, α,α-bis(neodecanoylperoxy)diisopropylbenzene, cumyl peroxyneodecanoate, 1,1,3,3-tetramethylbutyl peroxy-2-ethylhexanoate, 1,1,3,3-tetramethylbutyl peroxyneodecanoate, 1-cyclohexyl-1-methyethyl peroxyneodecanoate, 2,5-dimethyethyl-2,5-bis(2-ethylhexanoylperoxy)hexane, 1-cyclohexyl-1-methylethyl peroxy-2-ethylhexanoate, t-hexyl peroxyisopropyl monocarbonate, t-butyl peroxyisopropyl monocarbonate, t-butyl peroxy-2-hexyl monocarbonate, t-hexyl peroxybenzoate, 2,5-dimethyethyl-2,5-bis(benzoylperoxy)hexane, t-butyl peroxy-m-toluoyl benzoate, bis(t-butylperoxy)isophthalate, t-butyl peroxymaleic acid, t-butyl peroxy-3,5,5-trimethyl hexanoate, 2,5-dimethylethyl-2,5-bis(m-toluoylperoxy)hexane; diacyl peroxides such as benzoyl peroxide, lauroyl peroxide and isobutylyl peroxide; peroxydicarbonates such as diisopropyl peroxydicarbonate and bis(4-t-butylcyclohexyl) peroxydicarbonate; peroxyketals such as 1,1-di-t-butylperoxycyclohexane, 1,1-di-t-hexylperoxycyclohexane, 1,1-di-t-butylperoxy-3,3,5-trimethylcyclohexane and 2,2-di-t-butylperoxybutane; dialkyl peroxides such as di-t-butyl peroxide, dicumyl peroxide and di-t-butylcumyl peroxide; and others such as t-butyl peroxyallylmonocarbonate. Two or more types of any of these polymerization initiators may optionally be used in combination.

In producing the magnetic toner by suspension polymerization process, a composition containing at least the above magnetic material, polymerizable monomer and release agent is commonly dissolved or dispersed by means of a dispersion machine such as a homogenizer, a ball mill, a colloid mill or an ultrasonic dispersion machine to prepare a polymerizable monomer composition, and this is suspended in an aqueous medium containing a dispersion stabilizer. Here, a high-speed stirrer or a high-speed dispersion machine such as an ultrasonic dispersion machine may be used to make the toner particles have the desired particle size at a stretch, and this can more make the resultant toner particles have a sharp particle size distribution.

As the time at which the polymerization initiator is added, it may be added simultaneously when other additives are added to the polymerizable monomer, or may be mixed immediately before the polymerizable monomer composition is suspended in the aqueous medium. A polymerization initiator having been dissolved in the polymerizable monomer or in a solvent may also be added immediately after the granulation, or before the polymerization reaction is started.

After the granulation, agitation may be carried out by means of a usual agitator in such an extent that the state of particles is maintained and also the particles can be prevented from floating and settling.

In the case when the magnetic toner of the present invention is produced by polymerization, any known organic dispersant or inorganic dispersant may be used as the dispersion stabilizer. In particular, the inorganic dispersant may hardly cause any ultrafine powder, and may attain dispersion stability on account of its steric hindrance. Hence, even when reaction temperature is changed, it may hardly loose its stability, can be washed with ease, and may hardly affect the toner adversely. Thus, the inorganic dispersant may preferably be used. As examples of such an inorganic dispersant, it may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

When these inorganic dispersants are used, they may be used as they are. In order to obtain finer particles, particles of the inorganic dispersant may be formed in the aqueous medium when used. For example, in the case of tricalcium phosphate, an aqueous sodium phosphate solution and an aqueous calcium chloride solution may be mixed under high-speed agitation, whereby water-insoluble calcium phosphate can be formed and more uniform and finer dispersion can be made. Here, water-soluble sodium chloride is simultaneously formed as a by-product. However, the presence of such a water-soluble salt in the aqueous medium keeps the polymerizable monomer from being dissolved in water, to make any ultrafine toner particles become formed with difficulty by emulsion polymerization, and hence this is more favorable. Since its presence may be an obstacle when residual polymerizable monomers are removed at the termination of polymerization reaction, it is better to exchange the aqueous medium or to desalt it with an ion-exchange resin. The inorganic dispersant can substantially completely be removed by dissolving it with an acid or an alkali after the polymerization has been completed.

Any of these inorganic dispersants may be used alone in an amount of from 0.2 part by mass or more to 20 parts by mass or less, based on 100 parts by mass of the polymerizable monomer. It may also be used in combination with a surface-active agent used in an amount of from 0.001 part by mass or more to 0.1 part by mass or less.

Such a surface-active agent may include, e.g., sodium dodecylbenzene sulfate, sodium tetradecyl sulfate, sodium pentadecyl sulfate, sodium octyl sulfate, sodium oleate, sodium laurate, sodium stearate and potassium stearate.

In the step of polymerization, the polymerization may be carried out at a polymerization temperature set at 40° C. or above, and commonly at a temperature of from 50° C. or more to 90° C. or less. Inasmuch as the polymerization is carried out within this temperature range, the release agent may be better enclosed in toner particles. In order to make any residual polymerizable monomers react completely, the reaction temperature may be raised to 90° C. or more to 150° C. or less at the termination of polymerization reaction.

The polymerization toner particles may be, after the polymerization has been completed, subjected to filtration, washing and drying by conventional methods, and a classification step may optionally be added so as to remove coarse powder and fine powder. To the toner particles obtained, a fluidizing agent may also be added as an external additive.

In the present invention, an inorganic fine powder having a number-average primary particle diameter of from 4 nm or more to 80 nm or less may externally be added to the toner as the fluidizing agent. This is a preferred embodiment. The inorganic fine powder is added in order to improve the fluidity of the toner and make the charging of the toner particles uniform, where the inorganic fine powder may be subjected to treatment such as hydrophobic treatment so that the toner may further be endowed with the function to regulate its charge quantity and improve its environmental stability. As long as the inorganic fine powder has a number-average primary particle diameter within the above range, the toner can stably enjoy good charge characteristics and is also improved in fluidity. Hence, fog and toner scatter are kept from occurring. In order to make the toner particles have more uniform charge distribution, it is more preferable for the inorganic fine powder to have a number-average primary particle diameter of from 6 nm or more to 35 nm or less.

In the present invention, the number-average primary particle diameter of the inorganic fine powder may be measured in the following way. On a photograph of toner particles, taken under magnification on a scanning electron microscope, and further comparing it with a photograph of toner particles mapped with elements the inorganic fine powder contains, by an elemental analysis means such as XMA (X-ray microanalyzer) attached to the scanning electron microscope, at least 100 primary particles of the inorganic fine powder which are present in the state they adhere to or come liberated from toner particle surfaces are measured to determine their number-based average primary particle diameter, i.e., number-average primary particle diameter.

As the inorganic fine powder used in the present invention, fine silica powder, fine titanium oxide powder, fine alumina powder or the like may be used, and may be used alone or may be used in combination of two or more types. As the silica, usable are, e.g., what is called dry-process silica or fumed silica produced by vapor phase oxidation of silicon halides and what is called wet-process silica produced from water glass or the like, either of which may be used. The dry-process silica is preferred, as having less silanol groups on the particle surfaces and particle interiors of the fine silica powder and leaving less production residues such as $Na_2O$ and $SO_3^{2-}$. In the dry-process silica, it is also possible in the production step therefor to use, e.g., other metal halide such as aluminum chloride or titanium chloride together with the silicon halide to give a composite fine powder of silica with other metal oxide. The dry-process silica includes these as well. Of these, it is particularly preferable to use the fine silica powder. It may further preferably be fine silica powder having a specific surface area of from 20 $m^2/g$ or more to 350 $m^2/g$ or less, and more preferably from 25 $m^2/g$ or more to 300 $m^2/g$ or less, as measured by the BET method utilizing nitrogen absorption.

The specific surface area is measured according to the BET method, where nitrogen gas is adsorbed on sample particle surfaces using a specific surface area measuring instrument AUTOSOBE 1 (manufactured by Yuasa Ionics Co.), and the specific surface area is calculated by the BET multiple point method.

The inorganic fine powder having a number-average primary particle diameter of from 4 nm or more to 80 nm or less may preferably be added in an amount of from 0.1% by mass or more to 3.0% by mass or less, based on the mass of the toner particles.

The content of the inorganic fine powder may quantitatively be determined by fluorescent X-ray analysis and using a calibration curve prepared from a standard sample.

In the present invention, taking account of properties in a high-temperature and high-humidity environment, the inorganic fine powder may preferably be a powder having been hydrophobic-treated. Where the inorganic fine powder added to the toner has moistened, the toner particles may be charged in a very low quantity to tend to cause toner scatter.

As a treating agent used for such hydrophobic treatment, usable are a silicone varnish, a modified silicone varnish of various types, a silicone oil, a modified silicone oil of various types, a silane compound, a silane coupling agent, other organosilicon compound and an organotitanium compound. Any of these treating agents may be used alone or in combination to make treatment.

In particular, those having been treated with a silicone oil are preferred. Those obtained by subjecting the inorganic fine powder to hydrophobic treatment with a silane compound and, simultaneously with or after the treatment, treatment with a silicone oil are more preferred in order to maintain the charge quantity of the toner particles at a high level even in a high humidity environment and to prevent toner scatter.

In a method for such treatment of the inorganic fine powder, for example the inorganic fine powder may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

The silicone oil may preferably be one having a viscosity at 25° C. of from 10 $mm^2/s$ or more to 200,000 $mm^2/s$ or less, and more preferably from 3,000 $mm^2/s$ or more to 80,000 $mm^2/s$ or less. If its viscosity is less than 10 $mm^2/s$, the inorganic fine powder may have no stability, and the image quality tends to lower because of thermal and mechanical stress. If its viscosity is more than 200,000 $mm^2/s$, it tends to be difficult to make uniform treatment.

As the silicone oil used, particularly preferred are, e.g., dimethylsilicone oil, methylphenylsilicone oil, α-methylstyrene modified silicone oil, chlorophenylsilicone oil and fluorine modified silicone oil.

As a method for treating the inorganic fine powder with the silicone oil, for example the inorganic fine powder having been treated with a silane compound and the silicone oil may directly be mixed by means of a mixer such as Henschel mixer, or a method may be used in which the silicone oil is sprayed on the inorganic fine powder. Besides, a method may be used in which the silicone oil is dissolved or dispersed in a suitable solvent and thereafter the inorganic fine powder is added thereto and mixed, followed by removal of the solvent. In view of an advantage that agglomerates of the inorganic fine powder may less form, the method making use of a sprayer is preferred.

The silicone oil may be used for the treatment in an amount of from 1 part by mass or more to 40 parts by mass or less, and preferably from 3 parts by mass or more to 35 parts by mass or less, based on 100 parts by mass of the inorganic fine powder.

In the magnetic toner of the present invention, other additive(s) may further be used, as exemplified by fine carbon powders such carbon black and graphite powder; fine powders of metals such as copper, gold, silver, aluminum and nickel; metal oxides such as zinc oxide, titanium oxide, tin oxide, aluminum oxide, indium oxide, silicon oxide, magnesium oxide, barium oxide, molybdenum oxide and tungsten oxide; and molybdenum sulfide, cadmium sulfide and potassium titanate, or composite oxides of any of these; which may optionally be controlled on their particle size and particle size distribution. Also usable are lubricant powders such as polyethylene fluoride powder, zinc stearate powder and polyvinylidene fluoride powder; abrasives such as cerium oxide powder, silicon carbide powder and strontium titanate powder; anti-caking agents; and reverse-polarity organic fine particles and inorganic fine particles, which may be used in a small quantity as a developability improver. These additives may also be used after hydrophobic treatment of their particle surfaces.

A conductive inorganic oxide may also be added for the purpose of improving developing performance. Also usable are metal oxides doped with an element such as antimony or aluminum, and fine powders having a conductive material on particles surfaces, as exemplified by fine titanium oxide powder surface-treated with tin oxide and antimony, fine stannic oxide powder doped with antimony, and fine stannic oxide powder.

Commercially available conductive fine titanium oxide powder treated with tin oxide and antimony may include, e.g., EC-300 (available from Titan Kogyo K.K.); ET-300, HJ-1 and HI-2 (the foregoing are available from Ishihara Sangyo Kaisha, Ltd.); and W—P (available from Mitsubishi Materials Corporation).

Commercially available conductive tin oxide powder doped with antimony may include, e.g., T-1 (available from Mitsubishi Materials Corporation) and SN-100P (available from Ishihara Sangyo Kaisha, Ltd.). Commercially available fine stannic oxide powder may include, e.g., SH—S (available from Nihon Kagaku Sangyo Co., Ltd.)

As a means for externally adding the above inorganic fine powder, conductive fine powder or the like to toner particles, the toner particles and the fine powder may be mixed and agitated. Stated specifically, it may include Mechanofusion, I-type mill, Hybridizer, Turbo mill and Henschel mixer. From the viewpoint of preventing coarse particles from forming, it is particularly preferable to use Henschel mixer.

The magnetic toner of the present invention has superior durability, may cause less fog and has a high transfer performance, and hence may favorably be used in image forming methods making use of a contact charging step, and may further be used in cleanerless image forming methods.

An image forming method in which the magnetic toner of the present invention may be used is described below.

FIG. 1 is a diagrammatic sectional view showing the construction of an image forming apparatus. The image forming apparatus shown in FIG. 1 is an electrophotographic apparatus employing a developing system making use of a one-component developer magnetic toner. Reference numeral 100 denotes an electrostatic latent image bearing member (photosensitive drum), around which provided are a primary charging roller 117, a developing assembly 140, a transfer charging roller 114, a cleaner 116, a registration roller 124 and so forth. The photosensitive drum 100 is electrostatically charged to, e.g., −700 V by means of the primary charging roller 117 (AC applied voltage Vpp: 2 kV; DC voltage Vdc: −700 V). Then the photosensitive drum 100 is exposed by irradiating it with laser light 123 by means of a laser generator 121, thus an electrostatic latent image corresponding to an image to be formed is formed on the photosensitive drum 100. The electrostatic latent image formed on the photosensitive drum 100 is developed with the magnetic toner by means of the developing assembly 140 to form a toner image, which is then transferred to a transfer material by means of the transfer roller 114, which is brought into contact with the photosensitive drum via the transfer material. The transfer material holding the toner image thereon is transported to a fixing assembly 126 by a transport belt 125, and the toner image is fixed onto the transfer material. After the transfer step, the toner remaining on the photosensitive drum is removed by the cleaning means 116 to clean the surface.

Figure 2:
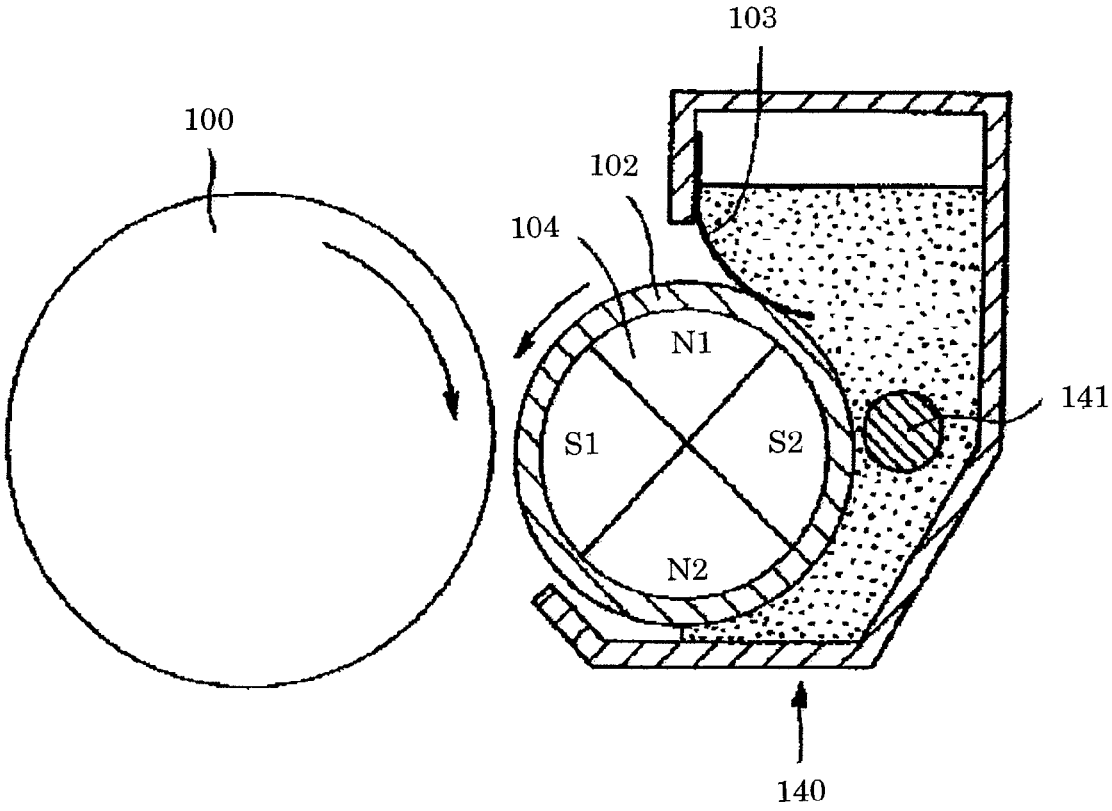
FIG. 2 is a diagrammatic sectional view showing an example of a developing assembly.

In the developing assembly 140, as shown in FIG. 2, a cylindrical toner carrying member (hereinafter "developing sleeve") 102 made of a non-magnetic metal such as aluminum or stainless steel is provided in proximity to the photosensitive drum 100. A gap between the photosensitive drum 100 and the developing sleeve 102 is maintained at a stated distance (e.g., about 300 μm) by the aid of a sleeve-to-photosensitive drum gap retaining member (not shown). In the interior of the developing sleeve 102, a magnet roller 104 is stationarily so provided as to be concentric to the developing sleeve 102. However, the developing sleeve 102 is rotatable. The toner is coated on the developing sleeve 102 by a toner coating roller 14, and is transported adhering thereto. As a member which controls the level of the magnetic toner thus transported, an elastic blade 103 is provided. The level of the toner to be transported to a developing zone is controlled by the pressure at which the elastic blade 103 comes into touch with the developing sleeve 102. In the developing zone, DC and AC developing biases are applied across the photosensitive drum 100 and the developing sleeve 102, and the electrostatic latent image formed on the photosensitive drum 100 is developed with the developer held on the developing sleeve 102.

How to measure physical properties in the present invention are describe below in detail.

Measurement of Average Circularity of Toner:

The average circularity of the toner is measured with a flow type particle analyzer "FPIA-2100 Model" (manufactured by Sysmex Corporation), and is calculated according to the following expression.

$$\text{Circle-equivalent diameter} = \left(\frac{\text{particle projected area}}{\Pi}\right)^{1/2} \times 2 \quad \text{Circularity} = \frac{\text{Circumferential length of a circle with the same area as particle projected area}}{\text{Circumferential length of particle projected image}}$$

Herein, the "particle projected area" is defined to be the area of a binary-coded toner particle image, and the "circumferential length of particle projected image" is defined to be the length of a contour line formed by connecting edge points of the toner particle image. In the measurement, used is the circumferential length of a particle image in image processing at an image processing resolution of 512×512 (a pixel of 0.3 μm 0.3 μm).

The circularity referred to in the present invention is an index showing the degree of surface unevenness of toner particles. It is indicated as 1.000 when the toner particles are perfectly spherical. The more complicate the surface shape is, the smaller the value of circularity is.

Average circularity C which means an average value of circularity frequency distribution is calculated from the following expression where the circularity at a partition point i of particle size distribution (a central value) is represented by ci, and the number of particles measured by m.

$$\text{Average circularity } C = \sum_{i=1}^{M} ci/m.$$

The measuring instrument FPIA-2100 used in the present invention calculates the circularity of each particle and thereafter calculates the average circularity and circularity standard deviation, where, according to circularities obtained, particles are divided into classes in which circularities of from 0.4 or more to 1.0 or less are equally divided at intervals of 0.01, and the average circularity is calculated using the divided-point center values and the number of particles measured.

As a specific way of measurement, 10 ml of ion-exchanged water from which impurity solid matter or the like has beforehand been removed is made ready in a container, and a surface active agent, preferably an alkylbenzenesulfonate, is added thereto as a dispersant. Thereafter, a sample for measurement is further added in an amount of 0.02 g, and is uniformly dispersed. As a means for dispersing it, an ultrasonic dispersion machine "TETORAL 50 Model" (manufactured by Nikkaki Bios Co.) is used, and dispersion treatment is carried out for 2 minutes to prepare a liquid dispersion for measurement. In that case, the liquid dispersion is appropriately cooled so that its temperature does not come to 40° C. or more. Also, in order to keep the circularity from scattering, the flow type particle analyzer FPIA-2100 is installed in an environment controlled to 23° C.±0.5° C. so that its in-machine temperature can be kept at 26° C. or more to 27° C. or less, and autofocus control is performed using 2 μm latex particles at intervals of constant time, and preferably at intervals of 2 hours.

In measuring the circularity of the toner particles, the above flow type particle analyzer is used and the concentration of the liquid dispersion is again so controlled that the toner particle concentration at the time of measurement is 3,000 particles/μl or more to 10,000 particles/μl or less, where 1,000 or more toner particles are measured. After the measurement, using the data obtained, the data of particles with a circle-equivalent diameter of less than 2 μm are cut, and the average circularity of the toner particles is determined.

EXAMPLES

The present invention is described below by giving production examples and working examples, which, however, by no means limit the present invention.

Surface-Treated Magnetic Material

Production Example 1

In an aqueous ferrous sulfate solution, a sodium hydroxide solution was mixed in an equivalent weight of from 1.0 or more to 1.1 or less, based on iron ions, to prepare an aqueous solution which contained ferrous hydroxide. Maintaining the pH of the aqueous solution at about 9, air was blown into it to effect oxidation at 80° C. or more to 90° C. or less to prepare a slurry fluid from which seed crystals were to be formed.

Subsequently, to this slurry fluid, an aqueous ferrous sulfate solution was so added as to be in an equivalent weight of from 0.9 to 1.2 based on the initial alkali content (the sodium component in the sodium hydroxide). Thereafter, maintaining the pH of the slurry fluid at about 8, oxidation reaction was carried on while air was blown into it. Magnetic iron oxide particles thus formed as a result of the oxidation reaction were washed, filtered and then taken out first. Here, a water-containing sample was collected in a small quantity, and its water content was beforehand measured. Then, this water-containing sample was, without being dried, re-dispersed in another aqueous medium. Thereafter, the pH of the re-dispersion formed was adjusted to about 6, and then a silane compound [n-$C_4H_9Si(OC_2H_5)_3$] was added thereto with thorough stirring, in an amount of 0.8 part by mass based on 100 parts by mass of magnetic iron oxide (the mass of magnetic iron oxide was calculated as a value obtained by subtracting the water content from the water-containing sample) to carry out coupling treatment. The hydrophobic iron oxide particles thus obtained were washed, filtered and then dried by conventional methods, followed by disintegration treatment of particles standing a little agglomerate, to obtain Surface-treated Magnetic Material 1. This magnetic material was 0.21 μm in number-average particle diameter and 48% in degree of hydrophobicity.

Surface-Treated Magnetic Material

Production Example 2

Surface-treated Magnetic Material 2 was obtained in the same way as in Surface-treated Magnetic Material Production Example 1 except that the silane compound was added in an amount changed to 1.2 parts by mass. This magnetic material was 0.21 μm in number-average particle diameter and 62% in degree of hydrophobicity.

Surface-Treated Magnetic Material

Production Example 3

Surface-treated Magnetic Material 3 was obtained in the same way as in Surface-treated Magnetic Material Production Example 1 except that the silane compound was changed for [n-$C_{10}H_{21}Si(OC_2H_5)_3$] and was added in an amount changed to 1.0 part by mass. This magnetic material was 0.21 μm in number-average particle diameter and 77% in degree of hydrophobicity.

Surface-Treated Magnetic Material

Production Example 4

Surface-treated Magnetic Material 4 was obtained in the same way as in Surface-treated Magnetic Material Production Example 1 except that the silane compound was changed for [n-$C_{22}H_{45}Si$ ($OC_2H_5$) 3] and was added in an amount changed to 1.5 parts by mass. This magnetic material was 0.21 μm in number-average particle diameter and 87% in degree of hydrophobicity.

Surface-Treated Magnetic Material

Production Example 5

Surface-treated Magnetic Material 5 was obtained in the same way as in Surface-treated Magnetic Material Production Example 1 except that the silane compound was added in an amount changed to 0.1 part by mass. This magnetic material was 0.21 μm in number-average particle diameter and 30% in degree of hydrophobicity.

Surface-treated Magnetic Material

Production Example 6

Surface-Treated Magnetic Material 6 was obtained in the same way as in Surface-treated Magnetic Material Production Example 1 except that the silane compound was changed for [n-$C_{10}H_{21}Si$ ($OC_2H_5$) 3] and was added in an amount changed to 0.1 part by mass. This magnetic material was 0.21 μm in number-average particle diameter and 35% in degree of hydrophobicity.

Surface-Untreated Magnetic Material

Production Example 1

Oxidation reaction was carried on in the same way as in Surface-treated Magnetic Material Production Example 1, and the magnetic material formed after the oxidation reaction was completed was washed, filtered, followed by drying, and then particles standing agglomerate were disintegrated to obtain Surface-untreated Magnetic Material 1. This magnetic material was 0.21 μm in number-average particle diameter.

Magnetic Toner

Production Example 1

Into 709 parts by mass of ion-exchanged water, 451 parts by mass of an aqueous 0.1 mol/liter $Na_3PO_4$ solution was introduced, followed by heating to 60° C. Thereafter, 67.7 parts by mass of an aqueous 1.0 mol/liter $CaCl_2$ solution was slowly added thereto to obtain an aqueous medium containing $Ca_3(PO_4)_2$.

Meanwhile, materials formulated as below were uniformly dispersed and mixed by means of an attritor (manufactured by Mitsui Miike Engineering Corporation) to prepare a monomer composition.

| | |
|---|---|
| Styrene | 75 parts by mass |
| n-Butyl acrylate | 25 parts by mass |
| Saturated polyester resin (1) (monomer constitution: bisphenol-A propylene oxide addition product/terephthalic acid/isophthalic acid; acid value: 9 mgKOH/g; Tg (glass transition temperature): 69° C.; Mn (number-average molecular weight): 4,200; Mw (weight-average molecular weight): 9,000) | 3 parts by mass |
| Negative charge control agent (T-77, a monoazo dye type Fe compound, available from Hodogaya Chemical Co., Ltd.) | 2 parts by mass |
| Cross-linking agent (PEG #400 dimethacrylate of the following formula; available from Kyoeisha Chemical Co., Ltd.) | 0.5 part by mass |

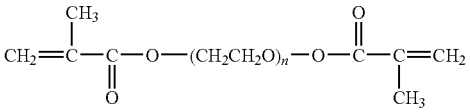

$n \approx 9$

| | |
|---|---|
| Surface-treated Magnetic Material 1 | 90 parts by mass |

This monomer composition was heated to 60° C., and 15 parts by mass of HNP-9 (paraffin wax; DSC endothermic main peak: 78° C.), available from Nippon Seiro Co., Ltd., was mixed therein to effect dissolution. In the mixture obtained, 5 parts by mass of a polymerization initiator benzoyl peroxide was dissolved to obtain a polymerizable monomer composition.

The polymerizable monomer composition was introduced into the above aqueous medium, and these were stirred at 60° C., and for 15 minutes at 12,000 rpm by means of CLEAMIX (manufactured by M TECHNIQUE Co., Ltd.) in an atmosphere of $N_2$ to carry out granulation. Thereafter, the granulated product obtained was stirred with a paddle stirring blade, during which the reaction was carried out setting the reaction initial-stage temperature at 50° C. and so raising the temperature as to come to 80° C. after 1.0 hour, and further the stirring was continued for 10 hours. After the reaction was completed, the suspension formed was cooled, and hydrochloric acid was added thereto to dissolve the $Ca_3(PO_4)_2$, followed by filtration, water washing and then drying to obtain magnetic toner particles.

100 parts by mass of the magnetic toner particles thus obtained and 1.0 part by mass of hydrophobic fine silica powder (i) obtained by treating silica powder with hexamethyldisilazane and thereafter with silicone oil (BET specific surface area after treatment: 180 $m^2/g$; primary average particle diameter: 10 nm; degree of hydrophobicity: 82%) were mixed by means of Henschel mixer (manufactured by Mitsui Miike Engineering Corporation) to obtain Magnetic Toner 1 (weight-average particle diameter D4: 7.5 μm) shown in Table 2.

Magnetic Toner

Production Example 2

Magnetic Toner 2 was produced in the same way as in Magnetic Toner Production Example 1 except that the cross-linking agent (PEG #400 dimethacrylate) was added in an amount changed to 1.0 part by mass and Surface-treated Magnetic Material 1 was changed for Surface-treated Magnetic Material 2. Physical properties of Magnetic Toner 2 are shown in Table 2.

Magnetic Toner

Production Example 3

Magnetic Toner 3 was produced in the same way as in Magnetic Toner Production Example 1 except that the cross-linking agent (PEG #400 dimethacrylate) was added in an amount changed to 0.1 part by mass. Physical properties of Magnetic Toner 3 are shown in Table 2.

Magnetic Toner

Production Example 4

Magnetic Toner 4 was produced in the same way as in Magnetic Toner Production Example 1 except that Surface-treated Magnetic Material 1 was changed for Surface-treated Magnetic Material 4. Physical properties of Magnetic Toner 4 are shown in Table 2.

Magnetic Toner

Production Example 5

Magnetic Toner 5 was produced in the same way as in Magnetic Toner Production Example 1 except that, as the cross-linking agent, 1,9-nonanediol dimethacrylate was used in place of the PEG #400 dimethacrylate. Physical properties of Magnetic Toner 5 are shown in Table 2.

| | |
|---|---|
| 1,9-Nonanediol dimethacrylate | 0.5 part by mass |

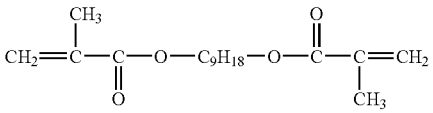

Magnetic Toner

Production Example 6

Magnetic Toner 6 was produced in the same way as in Magnetic Toner Production Example 5 except that Surface-treated Magnetic Material 3 was used in place of Surface-treated Magnetic Material 1. Physical properties of Magnetic Toner 6 are shown in Table 2.

Magnetic Toner

Production Example 7

Magnetic Toner 7 was produced in the same way as in Magnetic Toner Production Example 5 except that Surface-treated Magnetic Material 6 was used in place of Surface-treated Magnetic Material 1. Physical properties of Magnetic Toner 7 are shown in Table 2.

Magnetic Toner

Production Example 8

Magnetic Toner 8 was produced in the same way as in Magnetic Toner Production Example 1 except that, as the cross-linking agent, 1,6-hexanediol acrylate was used in place of the PEG #400 dimethacrylate. Physical properties of Magnetic Toner 8 are shown in Table 2.

Magnetic Toner

Production Example 9

Magnetic Toner 9 was produced in the same way as in Magnetic Toner Production Example 1 except that the reaction initial-stage temperature 40° C. was changed to 70° C. Physical properties of Magnetic Toner 9 are shown in Table 2.

Magnetic Toner

Production Example 10

Magnetic Toner 10 was produced in the same way as in Magnetic Toner Production Example 1 except that Surface-treated Magnetic Material 6 was used in place of Surface-treated Magnetic Material 1. Physical properties of Magnetic Toner 10 are shown in Table 2.

Comparative Magnetic Toner

Production Example 1

Comparative Magnetic Toner 1 was produced in the same way as in Magnetic Toner Production Example 1 except that, as the cross-linking agent, 3.0 parts of pentaerythritol tetraacrylate represented by the following formula A was added in place of the PEG #400 dimethacrylate, and Surface-treated Magnetic Material 4 was used in place of Surface-treated Magnetic Material 1.

Formula A

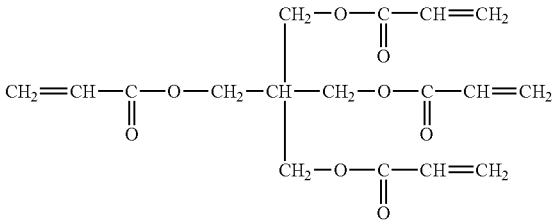

Comparative Magnetic Toner

Production Example 2

| | |
|---|---|
| Styrene/n-butyl acrylate copolymer (mass ratio: 78/22; number-average molecular weight Mn: 24,300; Mw/Mn: 3.0) | 100 parts by mass |
| Saturated polyester resin (1) as used in Magnetic Toner Production Example 1 | 5 parts by mass |
| Negative charge control agent (T-77, a monoazo dye type Fe compound, available from Hodogaya Chemical Co., Ltd.) | 1 part by mass |
| Surface-untreated Magnetic Material 1 | 90 parts by mass |
| Paraffin wax as used in Magnetic Toner Production Example 1 | 10 parts by mass |

The above materials were mixed by means of a blender, and the mixture obtained was melt-kneaded by means of a twin-extruder heated to 130° C. The kneaded product obtained and then cooled was crushed by means of a hammer mill, and then the crushed product obtained was finely pulverized using a jet mill. The finely pulverized product thus obtained was air-classified to obtain toner particles of 8.1 μm in weight-average particle diameter (D4). To 100 parts by weight of the toner particles obtained, 1.0 part by mass of the silica as used in Magnetic Toner Production Example 1 was added, and these were mixed by means of a Henschel mixer for 3 minutes, setting the stirring blade at a peripheral speed of 40 m/second, to prepare Comparative Magnetic Toner 2. Physical properties of Comparative Magnetic Toner 2 are shown in Table 2.

Comparative Magnetic Toner

Production Example 3

Comparative Magnetic Toner 3 was produced in the same way as in Magnetic Toner Production Example 1 except that 0.8 part by mass of divinylbenzene was added in place of the PEG #400 dimethacrylate and Surface-treated Magnetic Material 5 was used in place of Surface-treated Magnetic Material 1.

Comparative Magnetic Toner

Production Example 4

Comparative Magnetic Toner 4 was produced in the same way as in Magnetic Toner Production Example 1 except that 0.6 part by mass of pentaerythritol tetraacrylate was added in place of the PEG #400 dimethacrylate, Surface-treated Magnetic Material 4 was used in place of Surface-treated Magnetic Material 1 and the reaction temperature was set at 70° C.

Comparative Magnetic Toner

Production Example 5

Comparative Magnetic Toner 5 was produced in the same way as in Magnetic Toner Production Example 1 except that 0.5 part by mass of divinylbenzene was added in place of the PEG #400 dimethacrylate and the reaction initial-stage temperature was changed to 60° C.

Formulation and production process of Magnetic Toners 1 to 10 and Comparative Magnetic Toners 1 to 5 are shown in Table 1, and Physical properties of Magnetic Toners 1 to 10 and Comparative Magnetic Toners 1 to 5 are also shown in Table 2.

Example 1

Using Magnetic Toner 1, evaluation was made in the following way.

LBP3000 (14 sheets/minute; manufactured by CANON INC.) which was set at a process speed of 220 mm/sec and was so converted that the temperature of its fixing assembly was set changeable was used as an image forming apparatus, images were reproduced on 2,000 sheets in an intermittent mode to conduct a running test, in a low-temperature and low-humidity environment (15° C./10% RH). Here, an image making use of 8-point A-letters and of 3% in print percentage was used as an original image. Letter paper (basis weight: 75 g/m$^2$) available from Xerox Corporation was used as a recording medium.

Image Density:

After the running test was finished, solid images were formed, and the density of the solid images formed was measured with MACBETH Reflection Densitometer (manufactured by Gretag Macbeth Ag.).

A: 1.40 or more.

B: From 1.35 or more to less than 1.40.

C: From 1.30 or more to less than 1.35.

D: Less than 1.30.

Fog:

After the running test was finished, white images were reproduced, and the reflectance of the images formed was measured with REFLECTOMETER MODEL TC-6DS, manufactured by Tokyo Denshoku Co., Ltd. Meanwhile, about a transfer sheet (reference paper) on which no image has been formed, too, its reflectance was likewise measured. A green filter was used as a filter. From the values of reflectance before and after the reproduction of white images, fog was calculated according to the following expression.

Fog (%)=[reflectance (%) of reference paper]−[reflectance (%) of sample on which white images have been formed).

Evaluation criteria of the fog are as follows:

A: Very good (less than 1.5%).

B: Good (from 1.5% or more to less than 2.5%).

C: Average (from 2.5% or more to less than 4.0%).

D: Poor (4% or more).

Pressure Roller Staining:

After the running test was finished, how the pressure roller and images formed were stained with the toner was visually evaluated.

A: Any stain is seen neither on the pressure roller nor on the images.

B: Stain is little seen on the pressure roller, and no stain is seen on the images.

C: Stain is seen on the pressure roller, but no stain is seen on the images.

D: Stain is seen on the pressure roller, and stain is also seen on the images.

Fixing Test:

Using the conversion machine of LBP3000, having been set as above, a fixing test was also conducted in a normal-temperature and normal-humidity environment (23° C./60% RH).

First, halftone toner images were so formed on FOX RIVER BOND Paper as to give an image density of from 0.80 to 0.85, and the toner images were fixed at various temperatures, raising the temperature of the fixing assembly from 150° C. at intervals of 5° C. Thereafter, the fixed images formed were rubbed ten times with Silbon paper under application of a load of 55 g/cm$^2$, and the fixing temperature at which the rate of decrease in image density of the fixed images before and after the rubbing came to 10% was regarded as fixing start temperature.

Next, on A4-size 75 g/m$^2$ paper, solid images were so formed as to be 0.6 mg/cm$^2$ in toner mass per unit area, and the fixing temperature at which offset occurred at high temperature was examined, changing the temperature of the fixing assembly. High-temperature offset was observed by visually judging the fixed images on paper, and the highest temperature at which any high-temperature offset did not occur (i.e., fixing end temperature) was examined.

As the result, Magnetic Toner 1 was found to have a fixing start temperature of 165° C. and a fixing end temperature of 230° C. The results of evaluation are shown in Table 2.

About low-temperature anti-offset properties as well, the same solid images as those for evaluating the high-temperature anti-offset properties were formed, and the fixing temperature at which any stain due to an offset phenomenon appeared on the images at low temperature was examined.

Fixed-Image Density Uniformity:

The fixing assembly of the above LBP3000 conversion machine was detached, and the fixing was performed by using an external fixing assembly. The fixing making use of the external fixing assembly was performed under conditions of a process speed of 200 mm/sec, a fixing temperature of 195° C., a pressing force of 70 N and a nip of 6 mm. The 75 g/m$^2$ paper was also used as the recording medium. Under such conditions, solid black unfixed images were fixed. An average of image densities at three spots at the part of 1 cm from the upper end of the images obtained was regarded as upper end density, and an average of image densities at three spots at the part of 1 cm from the lower end of the images obtained was regarded as lower end density, to make evaluation.

As the image density, reflection density was measured with MACBETH Densitometer (manufactured by Gretag Macbeth Ag.) using an SPI filter. The smaller the difference in density between the image upper end and the image lower end is, the more superior in fixed-image density uniformity the toner is.

A: The density difference is less than 0.03.

B: The density difference is from 0.03 or more to less than 0.08.

C: The density difference is from 0.08 or more to less than 0.15.

D: The density difference is 0.15 or more.

Storage Stability:

10 g of the toner was put into a polyethylene cup of 50 ml in volume, and this was left to stand for 3 days in a 50° C.

thermostatic chamber, where evaluation was made on the extent of blocking of the toner.

A: The toner does not change in its fluidity.

B: The toner stands inferior in its fluidity, but recovers soon.

C: Agglomerates are seen, and are a little hard to break.

D: The toner has no fluidity, or has caused its caking.

Examples 2 to 10 and Comparative Examples 1 to 5

The same evaluations as the evaluations made in Example 1 were made on Magnetic Toners 2 to 10 and Comparative Magnetic Toners 1 to 5. The results of evaluation are shown in Table 3.

TABLE 1

| | Cross-linking agent | | Magnetic material | | | | |
|---|---|---|---|---|---|---|---|
| | Type | Amount (part) | Type | Treating agent | Amount of treating agent (part) | Reaction initial = stage temp. (° C.) | Polymerization process |
| | | | Magnetic Toner: | | | | |
| 1 | PEG#400 dimethacrylate | 0.5 | Surface-treated Magnetic Material 1 | Short chain(C4) | 0.8 | 50 | Suspension polymerization |
| 2 | PEG#400 dimethacrylate | 1.0 | Surface-treated Magnetic Material 2 | Short chain(C4) | 1.2 | 60 | Suspension polymerization |
| 3 | PEG#400 dimethacrylate | 0.1 | Surface-treated Magnetic Material 1 | Short chain(C4) | 0.8 | 50 | Suspension polymerization |
| 4 | PEG#400 dimethacrylate | 0.5 | Surface-treated Magnetic Material 4 | Long chain(C22) | 1.5 | 50 | Suspension polymerization |
| 5 | 1,9-Nonanediol dimethacrylate | 0.5 | Surface-treated Magnetic Material 1 | Short chain(C4) | 0.8 | 50 | Suspension polymerization |
| 6 | 1,9-Nonanediol dimethacrylate | 0.5 | Surface-treated Magnetic Material 3 | Medium chain(C10) | 1.0 | 50 | Suspension polymerization |
| 7 | 1,9-Nonanediol dimethacrylate | 0.5 | Surface-treated Magnetic Material 6 | Medium chain(C10) | 0.1 | 50 | Suspension polymerization |
| 8 | 1,6-Hexanediol dimethacrylate | 0.5 | Surface-treated Magnetic Material 1 | Short chain(C4) | 0.8 | 70 | Suspension polymerization |
| 9 | PEG#400 dimethacrylate | 0.5 | Surface-treated Magnetic Material 1 | Short chain(C4) | 0.8 | 70 | Suspension polymerization |
| 10 | PEG#400 dimethacrylate | 0.5 | Surface-treated Magnetic Material 6 | Medium chain(C10) | 0.1 | 50 | Suspension polymerization |
| | | | Comparative Magnetic Toner: | | | | |
| 1 | Pentaerythritol tetraacrylate | 3.0 | Surface-treated Magnetic Material 4 | Long chain(C22) | 1.5 | 50 | Suspension polymerization |
| 2 | — | — | Surface-untreated Magnetic Material 1 | — | — | Kneading: 130° C. | Pulverization |
| 3 | Divinylbenzene | 0.5 | Surface-treated Magnetic Material 5 | Short chain(C4) | 0.1 | 50 | Suspension polymerization |
| 4 | Pentaerythritol tetraacrylate | 0.6 | Surface-treated Magnetic Material 4 | Long chain(C22) | 1.5 | 50 | Suspension polymerization |
| 5 | Divinylbenzene | 0.5 | Surface-treated Magnetic Material 1 | Short chain(C4) | 0.8 | 60 | Suspension polymerization |

TABLE 2

| | Activation energy Ea (kJ/mol) | Activation energy Eb (kJ/mol) | Ea/Eb | THF-insoluble matter A (%) | Ea/A | Sc | THF-soluble matter peak molecular weight, Mp | Average circularity | D4/D1 |
|---|---|---|---|---|---|---|---|---|---|
| | | | | Magnetic Toner: | | | | | |
| 1 | 76.4 | 74.3 | 1.03 | 33.5 | 2.3 | 6.8 | 21,100 | 0.970 | 1.17 |
| 2 | 82.3 | 77.8 | 1.06 | 41.3 | 2.0 | 5.8 | 19,900 | 0.969 | 1.18 |
| 3 | 74.9 | 71.5 | 1.05 | 18.6 | 4.0 | 7.1 | 21,020 | 0.969 | 1.18 |
| 4 | 101.2 | 95.2 | 1.06 | 33.0 | 3.1 | 11.9 | 21,000 | 0.969 | 1.19 |
| 5 | 90.3 | 83.1 | 1.09 | 34.1 | 2.6 | 7.0 | 20,690 | 0.970 | 1.20 |
| 6 | 99.5 | 83.3 | 1.19 | 34.5 | 2.9 | 3.1 | 20,740 | 0.964 | 1.19 |
| 7 | 105.1 | 96.3 | 1.09 | 35.5 | 3.0 | 1.1 | 20,100 | 0.968 | 1.23 |
| 8 | 108.7 | 93.3 | 1.17 | 31.7 | 3.4 | 6.6 | 20,880 | 0.971 | 1.19 |
| 9 | 102.6 | 95.3 | 1.08 | 32.0 | 3.2 | 6.6 | 17,900 | 0.966 | 1.18 |
| 10 | 106.1 | 100.9 | 1.05 | 34.2 | 3.1 | 1.1 | 21,400 | 0.962 | 1.16 |
| | | | | Comparative Magnetic Toner: | | | | | |
| 1 | 190.9 | 189.3 | 1.01 | 76.9 | 2.5 | 15.6 | 24,400 | 0.959 | 1.25 |
| 2 | 161.6 | 110.3 | 1.47 | 30.0 | 5.4 | 1.0 | 54,000 | 0.943 | 1.41 |
| 3 | 122.2 | 116.3 | 1.05 | 34.0 | 3.6 | 1.2 | 29,300 | 0.948 | 1.23 |

TABLE 2-continued

| | Activation energy Ea (kJ/mol) | Activation energy Eb (kJ/mol) | Ea/Eb | THF-insoluble matter A (%) | Ea/A | Sc | THF-soluble matter peak molecular weight, Mp | Average circularity | D4/D1 |
|---|---|---|---|---|---|---|---|---|---|
| 4 | 133.8 | 118.3 | 1.13 | 48.0 | 2.8 | 14.0 | 20,900 | 0.965 | 1.22 |
| 5 | 116.3 | 95.8 | 1.21 | 30.5 | 3.8 | 6.3 | 22,330 | 0.969 | 1.21 |

TABLE 3

| | Pressure roller staining | Fixing start temp. (° C.) | Low-temp. offsetting at: (Low-temp. anti-offset properties) (° C.) | Density uniformity | Fixing end temp. (High-temp. anti-offset properties) (° C.) | Storage stability | Image density during running | Fog |
|---|---|---|---|---|---|---|---|---|
| | | | | Example: | | | | |
| 1 | A | 165 | 155 | A | 230 | A | 1.45 | 0.5 |
| 2 | A | 170 | 165 | A | 225 | B | 1.42 | 0.5 |
| 3 | B | 165 | 160 | A | 215 | A | 1.43 | 0.6 |
| 4 | C | 175 | 165 | B | 230 | B | 1.44 | 0.6 |
| 5 | B | 170 | 160 | B | 230 | A | 1.40 | 0.7 |
| 6 | B | 170 | 165 | C | 225 | A | 1.39 | 0.6 |
| 7 | C | 175 | 165 | B | 230 | A | 1.39 | 0.7 |
| 8 | C | 175 | 165 | C | 215 | A | 1.42 | 0.7 |
| 9 | B | 175 | 165 | B | 215 | B | 1.38 | 0.6 |
| 10 | C | 170 | 165 | B | 215 | A | 1.40 | 0.6 |
| | | | | Comparative Example: | | | | |
| 1 | D | 195 | 190 | B | 230 | B | 1.37 | 0.9 |
| 2 | C | 180 | 175 | D | 220 | A | 1.28 | 1.3 |
| 3 | D | 180 | 175 | C | 215 | A | 1.28 | 2.6 |
| 4 | C | 190 | 185 | D | 235 | B | 1.32 | 1.4 |
| 5 | C | 175 | 170 | D | 215 | A | 1.41 | 0.9 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-152223, filed Jun. 8, 2007, which is hereby incorporated by reference herein its entirety.

What is claimed is:

1. A magnetic toner which comprises toner particles containing at least a binder resin and a magnetic material, wherein;

the activation energy Ea (kJ/mol) that is determined from a shift factor $aT_{120}$ in a master curve of the toner, prepared when 120° C. is set as reference temperature, and the activation energy Eb (kJ/mol) that is determined from a shift factor $aT_{150}$ in a master curve of the toner, prepared when 150° C. is set as reference temperature, satisfy the following expression (1), and the Ea is 110 kJ/mol or less:

$$1.00 \leqq Ea/Eb < 1.20 \quad (1).$$

2. The magnetic toner according to claim 1, wherein the activation energy Ea (kJ/mol) and the THF-insoluble matter A (%) due to a binder resin component that is extracted by Soxhlet extraction made using tetrahydrofuran (THF) satisfy Expression (2):

$$1.0 \leqq Ea/A \leqq 5.0 \quad (2).$$

3. The magnetic toner according to claim 1, wherein, where the magnetic toner is dispersed in 5 mol/l of hydrochloric acid, the proportion Sc of the amount of extraction from the toner for an extraction time of from 3 minutes to 15 minutes ($S_{3-15}$) to the amount of extraction from the toner for an extraction time of from 15 minutes to 30 minutes ($S_{15-30}$), i.e., $S_{3-15}/S_{15-30}$, satisfies Expression (3):

$$1.2 \leqq Sc \leqq 10.0 \quad (3).$$

4. The magnetic toner according to claim 1, wherein THF-soluble matter of the toner has a peak molecular weight of from 15,000 or more to 40,000 or less as measured by gel permeation chromatography (GPC) of the same.

5. The magnetic toner according to claim 1, which has an average circularity of 0.950 or more.

6. The magnetic toner according to claim 1, wherein the toner particles have been produced in an aqueous medium.

* * * * *